US009052126B2

(12) United States Patent
Wu

(10) Patent No.: US 9,052,126 B2
(45) Date of Patent: Jun. 9, 2015

(54) HEAT EXCHANGE CIRCULATORY SYSTEM

(71) Applicant: INDUSTRIAL TECHNOLOGY RESEARCH INSTITUTE, Hsinchu (TW)

(72) Inventor: Hsiao-Yuan Wu, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 337 days.

(21) Appl. No.: 13/684,705

(22) Filed: Nov. 26, 2012

(65) Prior Publication Data

US 2014/0069137 A1 Mar. 13, 2014

(30) Foreign Application Priority Data

Sep. 7, 2012 (TW) ..... 101132877 A

(51) Int. Cl.
*F25B 41/00* (2006.01)
*F25B 1/00* (2006.01)
(Continued)

(52) U.S. Cl.
CPC . *F25B 1/00* (2013.01); *F25B 11/02* (2013.01); *F25B 27/00* (2013.01); *F25B 40/00* (2013.01); *F25B 41/00* (2013.01); *F25B 2339/047* (2013.01); *F25B 2400/141* (2013.01); *F28D 9/005* (2013.01); *F28D 9/0093* (2013.01); *F28D 2021/0068* (2013.01)

(58) Field of Classification Search
CPC ..... F25B 11/02; F25B 15/002; F25B 15/06; F25B 17/02; F25B 39/026; F25B 39/022; F25B 2309/005; F25B 2309/004; F25B 2339/0241; F25B 2400/19; F25B 2500/14; F25B 2500/26
USPC ..... 62/83, 115
See application file for complete search history.

(56) References Cited

U.S. PATENT DOCUMENTS 4,015,438 A 4/1977 Kinsell et al.
4,285,210 A * 8/1981 McCarty ..... 62/325
(Continued)

FOREIGN PATENT DOCUMENTS

CN 101517347 A 8/2009
TW I262215 B 9/2006

OTHER PUBLICATIONS

Butler, "Using air for cooling", Environmental Engineeering Centre A Gigiel and S Russell University of Bristol, pp. 1-12, Jan. 2001.
(Continued)

*Primary Examiner* — Cassey D Bauer
(74) *Attorney, Agent, or Firm* — Rabin & Berdo, P.C.

(57) ABSTRACT

A heat exchange circulation system includes a first and a second heat exchangers, an expansion device, and a compressor. There is a first flow path in the first heat exchanger and a second flow path in the second heat exchanger. The expansion pipe of the expansion device is connected to the second gas outlet of the second flow path and the first gas inlet of the first flow path. The compression pipe of the compressor is connected the first gas outlet of the first flow path and the second gas inlet of the second flow path. The first flow path, the compression pipe, the second flow path and the expansion pipe together form a heat exchange circuit. The liquid exists in the first flow path and the second flow path and the gas mixture circulates in the heat exchange circuit.

17 Claims, 20 Drawing Sheets

(51) Int. Cl.

| | |
|---|---|
| ***F25B 11/02*** | (2006.01) |
| ***F25B 27/00*** | (2006.01) |
| ***F25B 40/00*** | (2006.01) |
| ***F28D 9/00*** | (2006.01) |
| *F28D 21/00* | (2006.01) |

(56) References Cited

U.S. PATENT DOCUMENTS

| | | | | |
|---|---|---|---|---|
| 4,346,566 | A * | 8/1982 | McCarty et al. | 62/159 |
| 5,373,707 | A | 12/1994 | Ostersetzer et al. | |
| 6,041,615 | A | 3/2000 | Ostersetzer et al. | |
| 6,360,557 | B1 | 3/2002 | Reznik | |
| 6,913,076 | B1 * | 7/2005 | Hays | 165/274 |
| 8,181,470 | B2 | 5/2012 | Narayanamurthy et al. | |
| 2010/0025025 | A1 * | 2/2010 | Tomochika et al. | 165/166 |
| 2011/0023507 | A1 * | 2/2011 | Yana Motta et al. | 62/115 |
| 2011/0192188 | A1 * | 8/2011 | Nickey et al. | 62/507 |
| 2012/0000224 | A1 | 1/2012 | Kizawa et al. | |

OTHER PUBLICATIONS

Haack etal., "Novel Lightweight Metal Foam Heat Exchangers", Department of Engineering, University of Cambridge, pp. 1-7, 2001.

Kühnl-Kinel, "New Age Water Chillers With Water As Refrigerant", 1st ST Workshop, Chamonix, France, pp. 106-111, Feb 1998.

Ren, "Construction of a generalized psychrometric chart for different pressures", International Journal of Mechanical Engineering Education, vol. 32, No. 3, pp. 212-222, Jul. 2004.

Kilicarslan et. al., "A comparative study of water as a refrigerant with some current refrigerants", International Journal of Energy Research, vol. 29, pp. 947-959, Jul. 2005.

Taiwan Patent Office, Office Action, Patent Application Serial No. TW101132877, Jan. 13, 2015, Taiwan.

* cited by examiner

HEAT EXCHANGE CIRCULATORY SYSTEM

CROSS-REFERENCE TO RELATED APPLICATIONS

This non-provisional application claims priority under 35 U.S.C. §119(a) on Patent Application No(s). 101132877 filed in Taiwan, R.O.C. on Sep. 7, 2012, the entire contents of which are hereby incorporated by reference.

BACKGROUND

1. Technical Field

The disclosure relates to a heat exchange circulation system and, more specifically, a heat exchange circulation system utilizing mixture of gas and liquid as its heat transfer medium.

2. Background

Traditional heat exchange circulation systems often use refrigerants, which dissolve the Earth's ozone layer, for heat exchange. Whenever such refrigerant leaks, it can easily cause greenhouse effect and damage to the Earth's ozone layer. Although some vendors use coolant posing less environment impact instead, the heat transfer efficiency of these coolant usually are low.

As a result, inventing designs that use heat transfer mediums without causing environmental problems and are with high heat transfer efficiency remains a major challenge for industrial manufacturers.

SUMMARY

The present disclosure is to provide a heat exchange circulation system comprising a first heat exchanger, a second heat exchanger, an expansion device, and a compressor. A first flow path, which resides in the first heat exchanger, has a first gas inlet and a first gas outlet. A second flow path, which resides in the second heat exchanger, has a second gas inlet and a second gas outlet. The expansion device has an expansion pipe connecting the second gas outlet of the second flow path and the first gas inlet of the first flow path. The compressor has a compression pipe that connects the first gas outlet of the first flow path and the second gas inlet of the second flow path. The first flow path, the compression pipe, the second flow path and the expansion pipe together form a heat exchange circuit. The heat exchange circuit has a fluid medium flowing within it. The fluid medium includes a liquid and a gas mixture. The liquid exists in the first flow path and the second flow path and gas mixture circulates in the heat exchange circuit.

The theory utilized in the heat transfer circulation system of the present disclosure is that the gas temperature drops due to gas expansion characteristics. The gas is kept in low temperature prior to entering the first flow path and facilitates an endothermic effect through the first flow path. According to the fact that the gas temperature increases during an adiabatic compression, the gas is kept in high temperature prior to entering the second flow path and facilitates an exothermic effect through the second flow path. To implement the endothermic properties of the liquid upon changing to the gas through an evaporation process, the liquid is fed in the first flow path to absorb heat. Further exothermic effect when the gas is condensed to a liquid, is included by having the gas to release heat while undergoes condensation in the second flow path. The implementations of the evaporation and condensation between the liquid and the gas described above increase the heat transfer efficiency of the heat exchange circulation system.

BRIEF DESCRIPTION OF THE DRAWINGS

The present disclosure is more fully understood from the detailed description given herein below for illustration only, and thus are not limitative of the present disclosure, and wherein.

DETAILED DESCRIPTION

The novel features which are characteristic of the present disclosure are set forth in the appended claims. Advantages of the present disclosure and the disclosure's preferred embodiments are better understood and implemented by reference to the following detailed descriptions in connection with the accompanying drawings to those who are familiar with the related technology. The following descriptions are exemplary embodiments only to address the features and advantages, and are not intended to limit the scope, applicability or configuration, of the present disclosure in any way. Various changes to the described embodiments may be made in the functionality and arrangement of the elements described without departing from the scope of the disclosure as set forth in the claims herein.

Figure 1A:
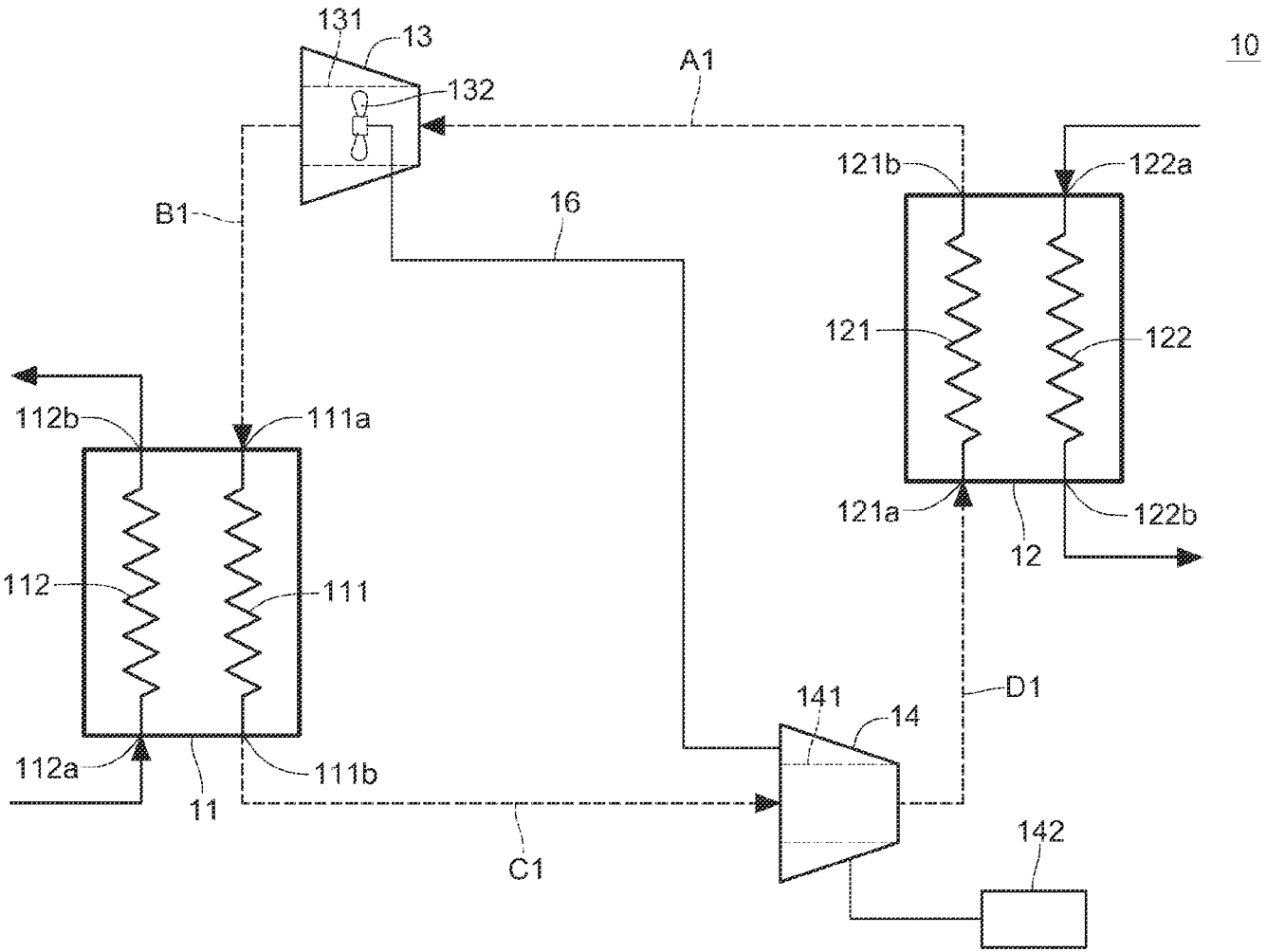
FIG. 1A is a composite diagram of an embodiment of a heat exchange circulation system of the present disclosure.
Figure 1B:
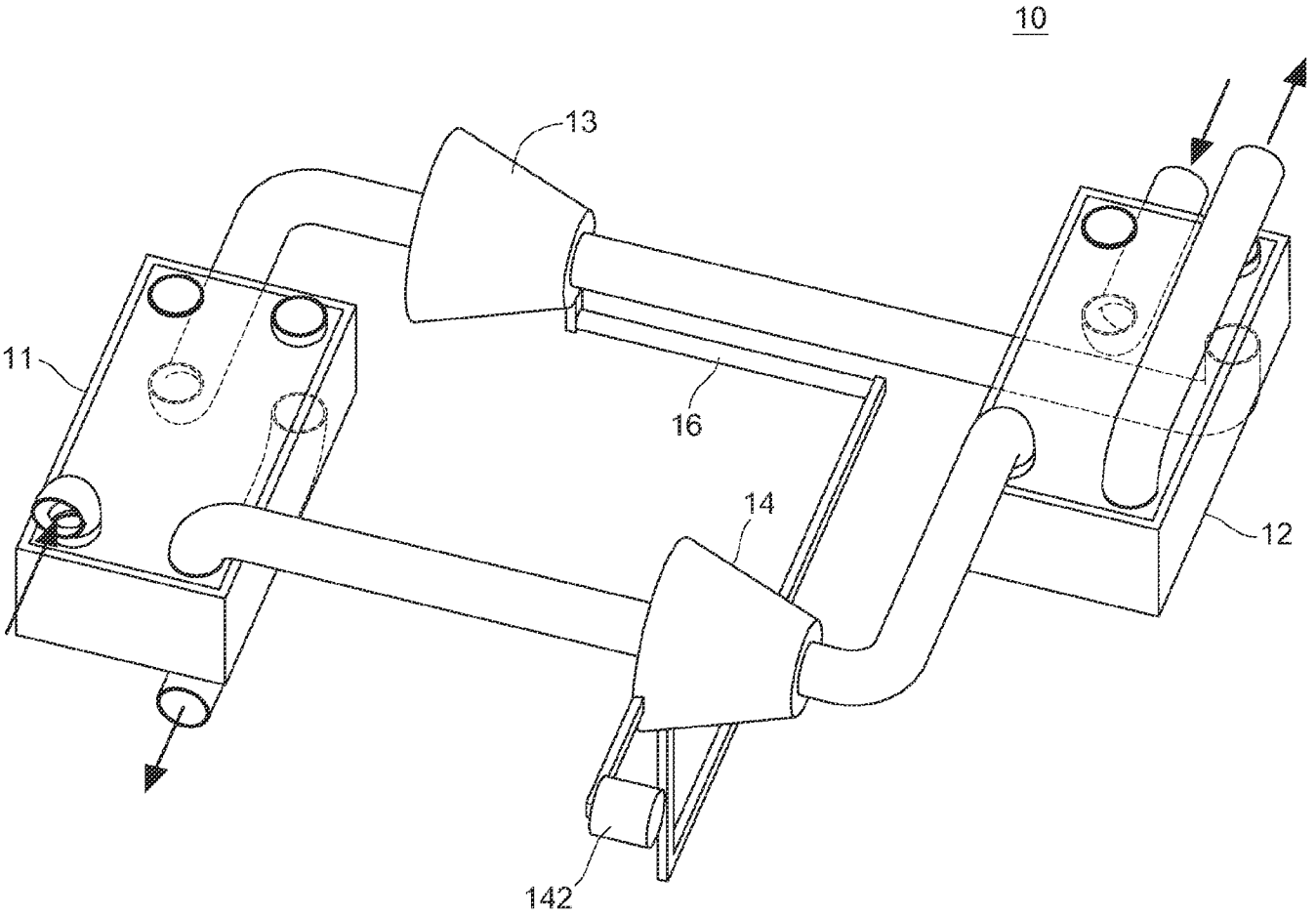
FIG. 1B is a three dimensional composite layout of the heat exchange circulation system described in FIG. 1A.
Figure 1C:
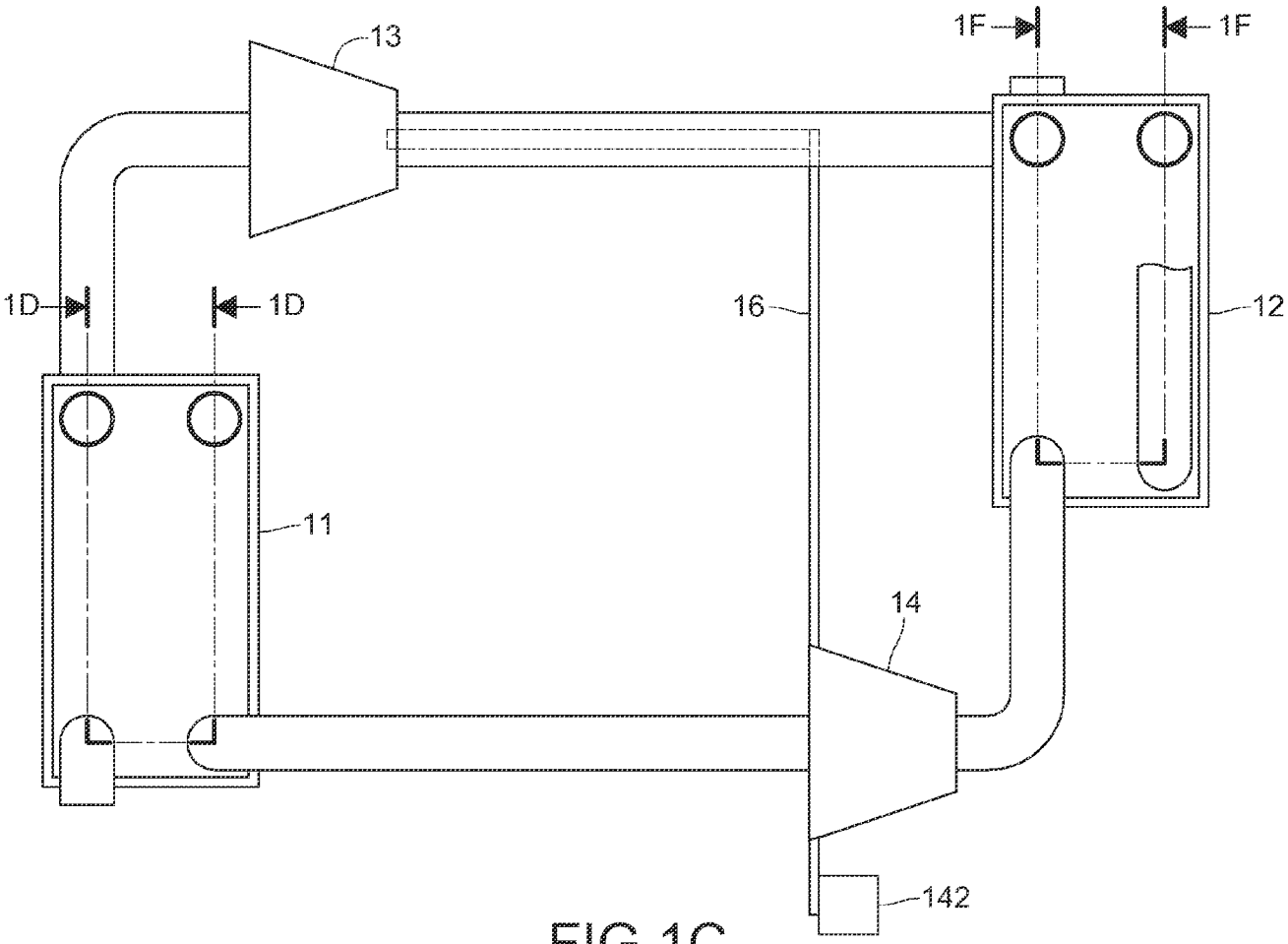
FIG. 1C is a top view of the heat exchange circulation system described in FIG. 1B.

With reference to FIGS. 1A, 1B and 1C, FIG. 1A is a schematic view of an embodiment of the heat transfer circulation system 10 of the present disclosure, FIG. 1B is a three dimensional composite layout of the heat transfer circulation system 10 in FIG. 1A, and FIG. 1C is a top view of the heat transfer circulation system 10 in FIG. 1B. The heat transfer circulation system 10 includes a first heat exchanger 11, a second heat exchanger 12, an expansion device 13 and a compressor 14. Inside the first heat exchanger 11, there are a first flow path 111 and a heat absorbing pipe 112. The first flow path 111 has a first gas inlet 111*a* and a first gas outlet 111*b*. Inside the second heat exchanger 12, there are a second flow path 121 and a heat dissipating pipe 122. The second flow path 121 has a second gas inlet 121*a* and a second gas outlet 121*b*. The expansion device 13 has an expansion pipe 131 that is connected to the second gas outlet 121*b* of the second flow path and the first gas inlet 111*a* of the first flow path. The compressor 14 has a compression pipe 141 that is connected to the first gas outlet 111*b* of the first flow path and the second gas inlet 121*a* of the second flow path. The first flow path 111, the compression pipe 141, the second flow path 121 and the expansion pipe 131 together form a heat exchange circuit. The heat exchange circuit has a fluid medium flowing within it. The fluid medium includes a liquid and a gas mixture. The liquid exists in the first flow path 111 and the second flow path 121 and gas mixture circulates in the heat exchange circuit. Heat is transferable between the first flow path 111 and the heat absorbing pipe 112, but their fluid mediums are not. Heat is transferable between the second flow path 121 and the heat dissipating pipe 122, but their fluid mediums are not.

In the present embodiment and some embodiments, the heat exchange circulation system 10 further includes a transmission device 16. The expansion device 13 further includes a blade 132. Compressor 14 is connected to a motor 142 for compressing the gas mixture. The blade 132 is placed in the expansion pipe 131. The transmission device 16 is connected to the axis of the blade 132 and the compressor 14 in order to transfer the work produced by the gas mixture upon turning the blade to the compressor, so that compressor can compress the gas mixture with less energy from the motor 142.

In the present embodiment, the heat absorbing pipe 112 has a heat absorbing inlet 112*a* and a heat absorbing outlet 112*b*. The heat dissipating pipe 122 has a heat dissipating inlet 122*a* and a heat dissipating outlet 122*b*. The medium that is desired to be cooled is transferred into the heat absorbing pipe 112 through the heat absorbing inlet 112*a* to release heat before the medium departs the heat absorbing pipe 112 from the heat absorbing outlet 112*b*. The medium that is desired to be heated can be fed through the heat dissipating inlet 122*a* into the heat dissipating pipe 122 to absorb heat before the medium departs the heat dissipating pipe 122 from the heat dissipating outlet 122*b*. The medium desired to be cooled down can be indoor air processed by the air conditioner. In such case, the medium desired to be heated is the outdoor air processed by the air conditioner. Thus the heat of the indoor air is transferred to the outdoor air through the heat exchange circulation system 10.

In the present embodiment, the liquid is, for example, water and the gas mixture is, for example, a mixture of water vapor and air. Prior to entering the expansion device 13, the gas mixture A1 is a gas mixture of saturated water vapor and air. The gas mixture A1 in the expansion pipe 131 expands while passing through the expansion device 13 and becomes a gas mixture of water vapor and air B1 that has lower temperature and less pressure than those of gas mixture A1. Owing to the heat exchange between the first flow path 111 and the heat absorbing pipe 112, after the gas mixture B1 enters the first flow path 111 through the first gas inlet 111*a*, the gas mixture B1 absorbs the heat from the medium that is supposed to be cooled in the heat absorbing pipe 112. In addition, the liquid water inside the first flow path 111 also absorbs the heat from the medium, that is supposed to be cooled in the heat absorbing pipe 112, and becomes water vapor. Therefore, the gas mixture C1 released from the first flow path 111 through the first gas outlet 111*b* is a gas mixture of saturated water vapor and air whose temperature is higher than that of gas mixture B1.

The gas mixture C1 entering the compressor 14 undergoes an adiabatic or near adiabatic compression process. Thus, the gas mixture D1, released from the compression pipe 141, is a gas mixture of unsaturated water vapor and air with higher temperature and pressure than those of gas mixture C1. Owing to the heat exchange between the second flow path 121 and the heat dissipating pipe 122, after the gas mixture D1 enters the second flow path 121 through the second gas inlet 121*a*, the gas mixture D1 dissipates its heat to the medium that is supposed to be heated in the heat dissipating pipe 122. In addition, the heat of the gas mixture D1 is further reduced when the water vapor of the gas mixture D1 is condensed to liquid water inside the second flow path 121. Thus, the gas mixture A1 released from the second flow path 121 through the second gas outlet 121*b* becomes a gas mixture of saturated water vapor and air again. In the present embodiment, the liquid water in the first flow path 111 can be refilled with outer water. The liquid water in the second flow path 121 can be discharged outside the heat exchange circulation system 10, but this embodiment is not intended to limit ways to refill water in the first flow path 111 and way to discharge water out of the second flow path 121.

Figure 1D:
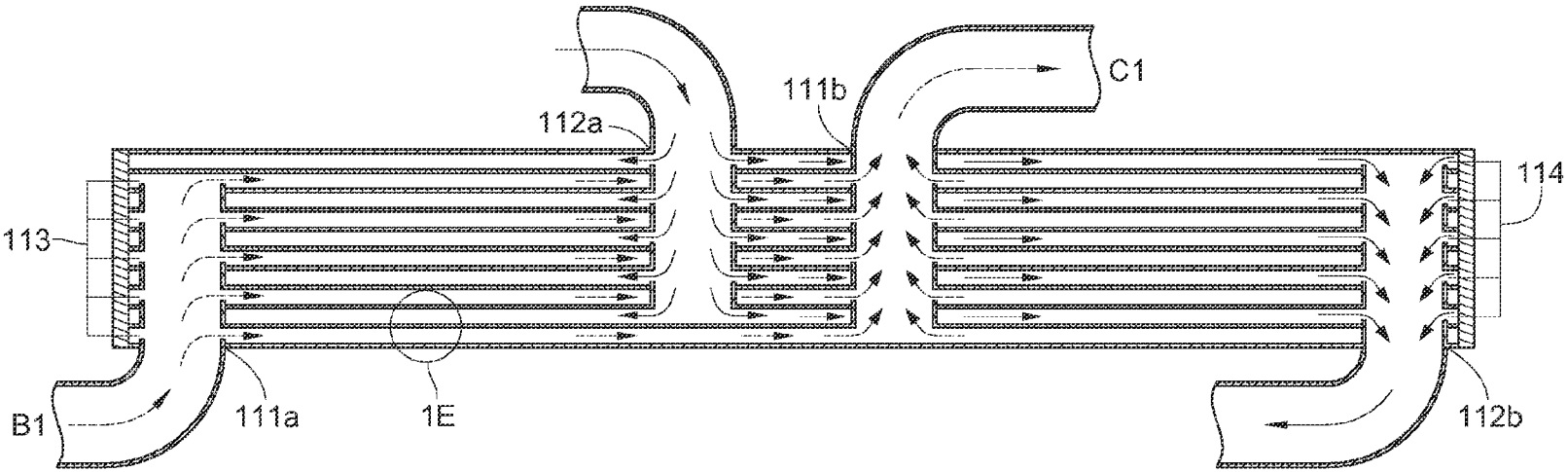
FIG. 1D is a sectional schematic view of the first heat exchanger described in FIG. 1C along the 1D-1D cutting plane line.
Figure 1E:
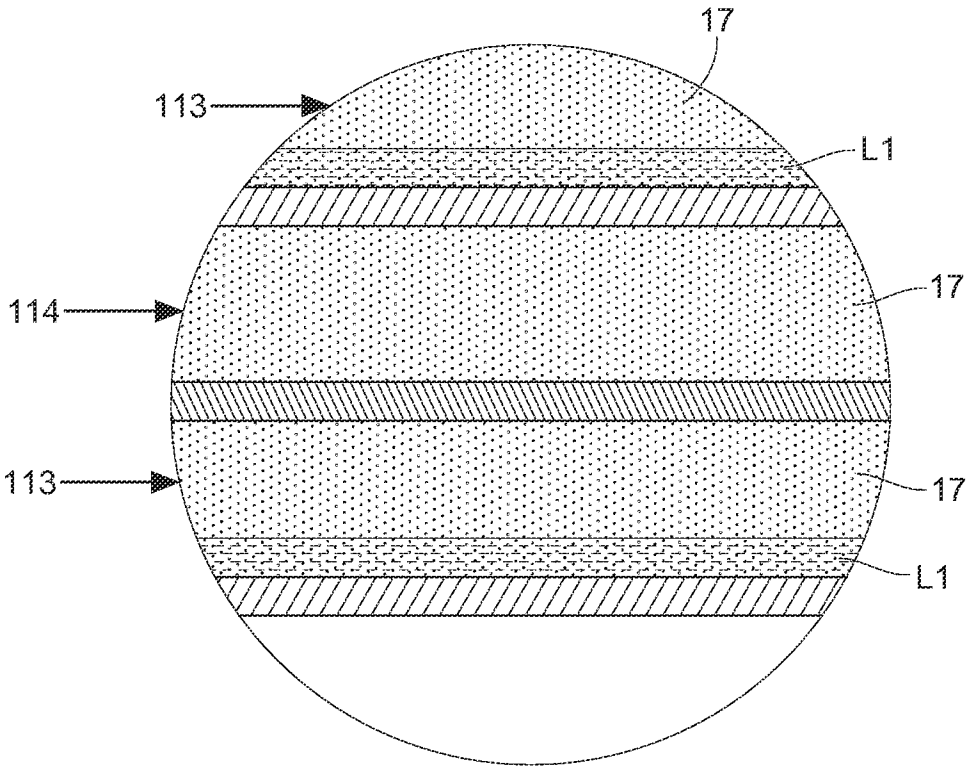
FIG. 1E is a partially enlarged section view of an area shown in FIG. 1D.

With reference to FIGS. 1D and 1E, FIG. 1D is a sectional schematic view of the first heat exchanger 11 in FIG. 1C along the line 1D-1D, while FIG. 1E is a partially enlarged section view of an area shown in FIG. 1D. The first heat exchanger 11 is a plate type heat exchanger, which includes multiple, thin, slightly separated plates orderly stacked together, to provide a plurality of heat exchange regions for heat transfer among the medium to be cooled, the mixture of water vapor and air, and the liquid water L1. The odd-numbered heat exchange space 113 represented by odd-numbered heat exchange regions located from the bottom of the plate type heat exchanger forms the first flow path 111 illustrated in FIG. 1A, and the even-numbered heat exchange space 114 represented by even-numbered heat exchange regions located from the bottom of the plate type heat exchanger forms the heat absorbing pipe 112. The gas mixture B1 that enters the odd-numbered regions of odd-numbered heat exchange space 113 from the first gas inlet 111*a* is converted to the gas mixture C1 before exits from the odd-numbered regions of odd-numbered heat exchange space 113 through the first gas outlet 111*b*. Furthermore, there is liquid water L1 flowing in the odd-numbered heat exchange space 113. Medium to be cooled enters the even-numbered heat exchange space 114 from the heat absorbing inlet 112*a* and exits the even-numbered heat exchange space 114 through the heat absorbing outlet 112*b*.

The temperature of the medium to be cooled in the even-numbered heat exchange space 114 is higher than those of the gas mixture B1 and liquid water L1 in the odd-numbered heat exchange space 113. Thus, heat is transferred from the medium to be cooled to the gas mixture B1 and liquid water L1, as a result, reducing the temperature of the medium to be cooled. As heat is transferred to the gas mixture B1 and to the liquid water L1, the temperature of the gas mixture B1 increases and the liquid water L1 evaporates and becomes water vapor and mixed with the gas mixture B1, thus forming the gas mixture C1. The heat exchange circulation system 10 shown in FIG. 1B also includes a plurality of porous heat transfer medium 17. As illustrated in FIG. 1E, the porous heat transfer medium 17 is installed in the odd-numbered heat exchange space 113 that forms the first flow path 111, and in the even-numbered heat exchange space 114 that forms the heat absorbing pipe 112. The porous heat transfer medium 17 is, for example, a metal foam. The porous heat transfer medium 17 with intercommunicated holes allows the gas mixture B1 and C1 passing through itself and can immerge in and absorb the liquid water L1. Since the porous heat transfer medium 17 has larger surface in contact with the liquid water L1, the evaporation rate of the liquid water L1 increases. The porous heat transfer medium 17 has bigger thermal conductivity than that of a gas mixture, thus being able to increase the heat exchanger efficiency of the first heat exchanger 11.

Figure 1F:
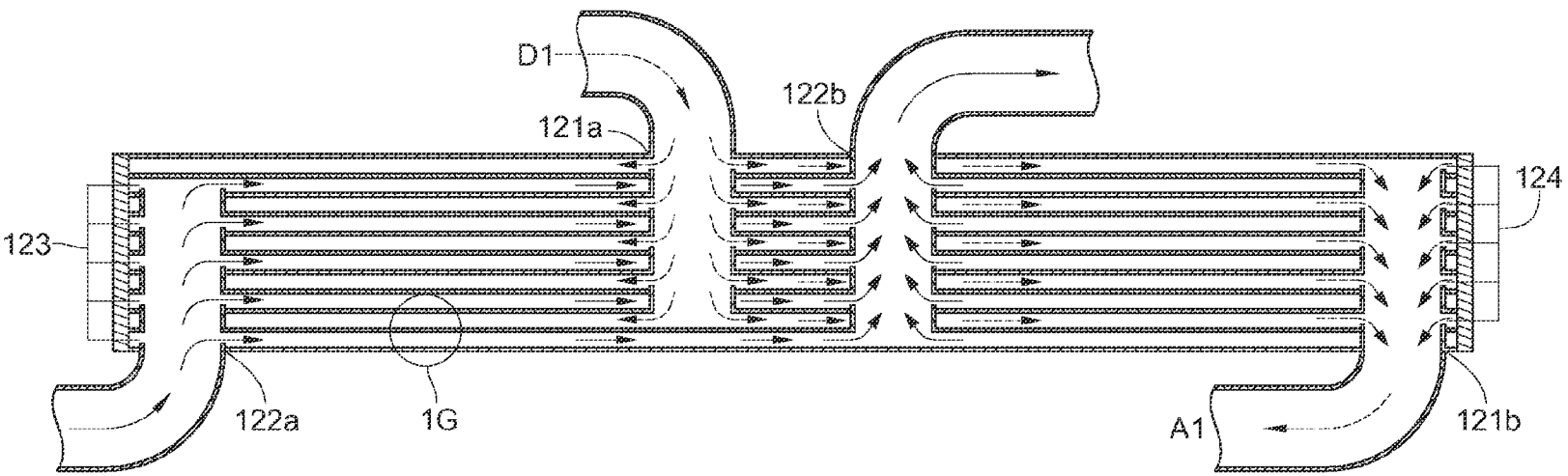
FIG. 1F is a sectional schematic view of the second heat exchanger described in FIG. 1C along the 1F-1F cutting plane line.
Figure 1G:
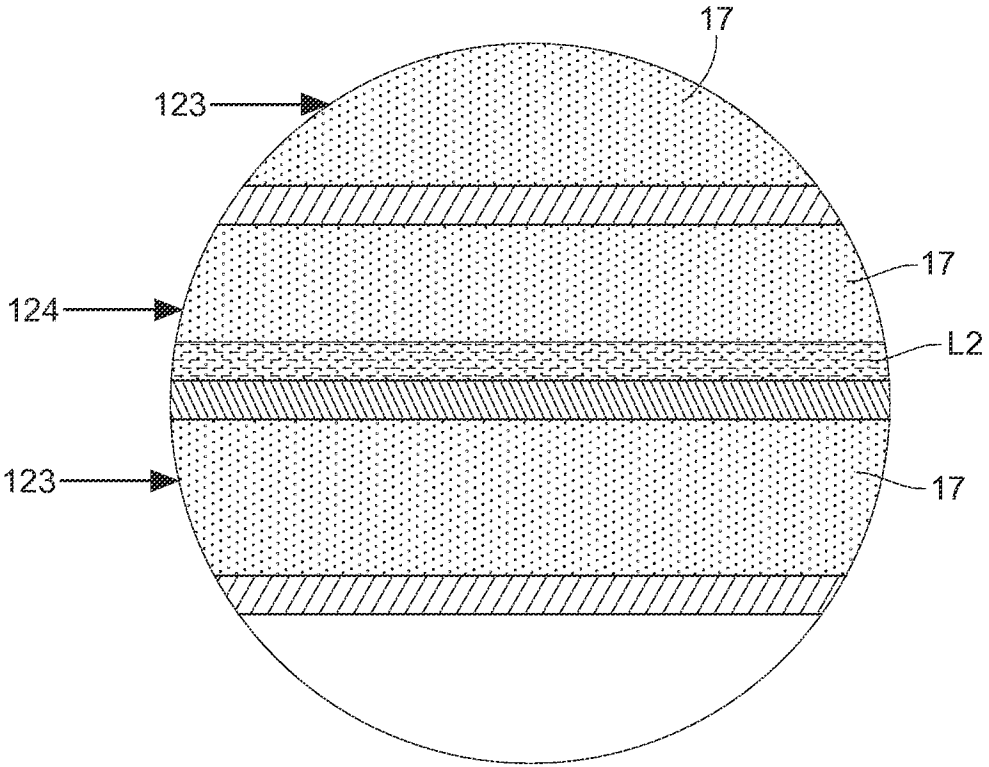
FIG. 1G is a partially enlarged section view of an area shown in FIG. 1F.

With reference to FIGS. 1F and 1G, FIG. 1F is a sectional schematic view of the second heat exchanger 12 shown in FIG. 1C along the line 1F-1F, whereas FIG. 1G is a partially enlarged section view of an area shown in FIG. 1F. The second heat exchanger 12 is also a plate type heat exchanger, which is composed of multiple, thin, slightly separated plates orderly stacked together, to provide a plurality of heat exchange regions for heat transfer among medium to be heated, mixture of water vapor and air, and liquid water L2. The even-numbered heat exchange space 124 represented by even-numbered heat exchange regions located from the bottom forms the second flow path 121 illustrated in FIG. 1A and the odd-numbered heat exchange space 123 represented by odd-numbered heat exchange regions located from the bottom forms the heat dissipating pipe 122. The gas mixture D1 that enters the even-numbered heat exchange space 124 from the second gas inlet 121*a* is converted to the gas mixture A1 before exits from the even-numbered heat exchange space 124 through the second gas outlet 121*b*. In addition, there is the liquid water L2 flows in the even-numbered heat exchange space 124. Medium to be heated enters the odd-numbered heat exchange space 123 from the heat dissipating inlet 122*a* and exits from the odd-numbered heat exchange space 123 through the heat dissipating outlet 122*b*. The temperature of the medium to be heated in the odd-numbered heat exchange space 123 is lower than those of the gas mixture D1 and liquid water L2 in the even-numbered heat exchange space 124. Thus, heat is transferred from the gas mixture D1 and liquid water L2 to the medium to be heated, as a result, increasing the temperature of the medium to be heated. As heat is released by the gas mixture D1, the temperature of the gas mixture D1 decreases, the water vapor of the gas mixture D1 is condensed to liquid water L2, and the remaining gas mixture forms the gas mixture A1. The liquid water L2 remains in the even-numbered heat exchange space 124. The heat exchange circulation system 10 shown in FIG. 1B also includes a plurality of porous heat transfer medium 17. As illustrated in FIG. 1G, the porous heat transfer medium 17, such as a metal foam, is installed in the even-numbered heat exchange space 124 that form the second flow path 121, and in the odd-numbered heat exchange space 123 that form the heat dissipating pipe 122. The existence of a medium offers a better and faster condensation process than without the medium. Therefore, the installation of porous heat transfer medium 17 in the flow paths and pipes not only allows the gas mixture D1 and the gas mixture A1 to pass through but also improves the condensation rates of both gas mixtures. The porous heat transfer medium 17 has higher thermal conductivity, thus can increase the heat exchange efficiency of the second heat exchanger 12.

Figure 2A:
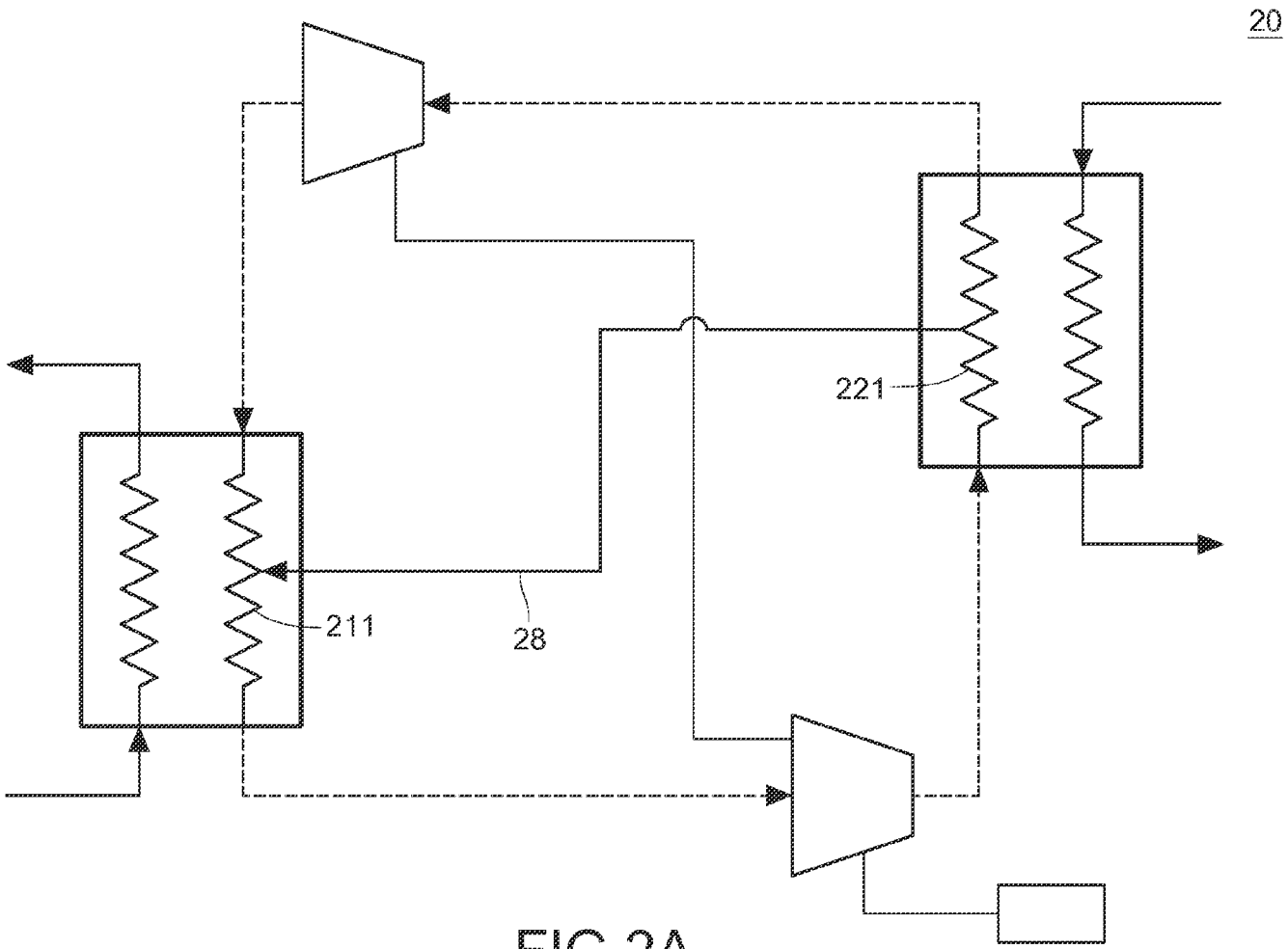
FIG. 2A is a schematic view of another embodiment of a heat exchange circulation system of the present disclosure.
Figure 2B:
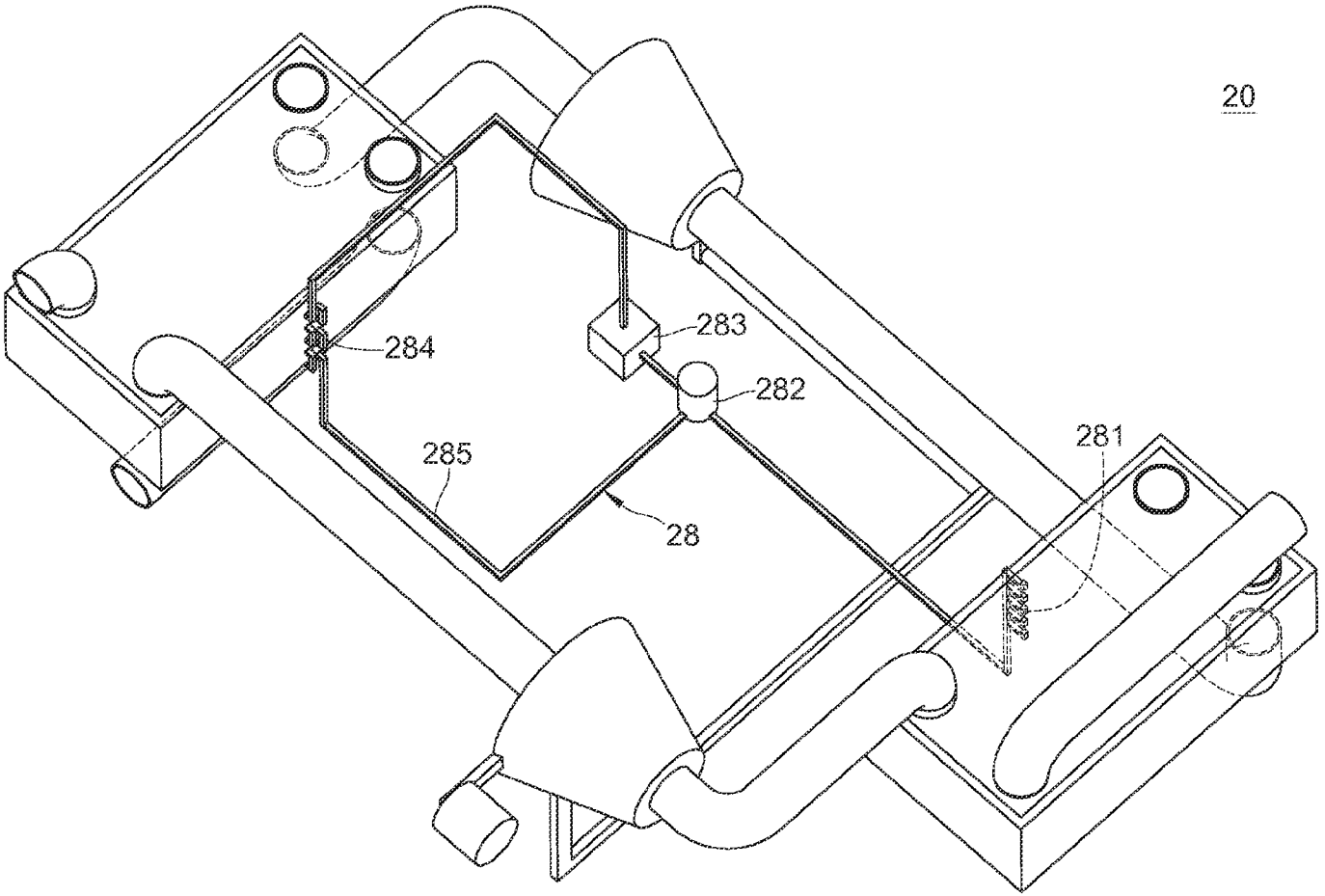
FIG. 2B is a three dimensional composite layout of the heat exchange circulation system illustrated in FIG. 2A.

With reference to FIGS. 2A and 2B, FIG. 2A is a schematic view of another embodiment of a heat exchange circulation system 20 of the present disclosure and FIG. 2B is a three dimensional composite layout of the heat exchange circulation system 20 illustrated in FIG. 2A. The heat exchange circulation system 20 of this embodiment is similar to the heat exchange circulation system 10 shown in FIG. 1A. However, the heat exchange circulation system 20 of this embodiment further includes a liquid return line 28. The liquid return line 28 is connected to the first flow path 211 and the second flow path 221. Liquid from the second flow path 221 is directed to the first flow path 211 through the liquid return line 28 in order to balance the liquid volumes in the first flow path 211 and the second flow path 221.

For example, the liquid return line 28 includes a collection tube 281, a liquid collection container 282, a pump 283, a distribution tube 284 and an overflow tube 285. The collection tube 281 gathers the liquid in the second flow path 221 into the liquid collection container 282. The collected liquid then is pumped to the distribution tube 284, leading the collected liquid into the first flow path 211, from the liquid collection container 282 by the pump 283. Any residual liquid is routed back to the liquid collection container 282 through the overflow tube 285. Thus, the excess liquid in the second flow path 221 is fed to the first flow path 211 through the liquid return line 28.

Figure 3A:
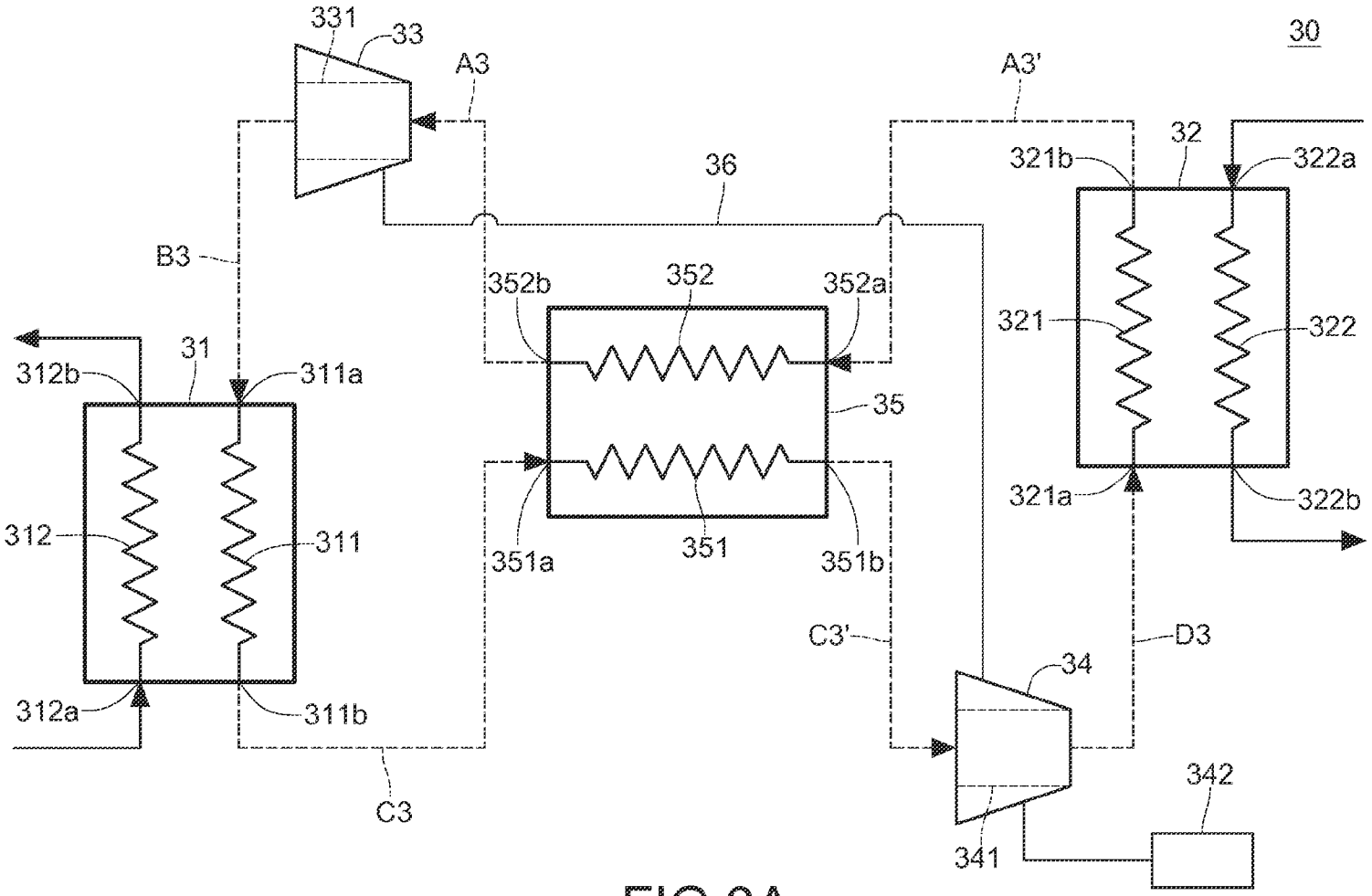
FIG. 3A is a schematic view of another embodiment of a heat exchange circulation system of the present disclosure.
Figure 3B:
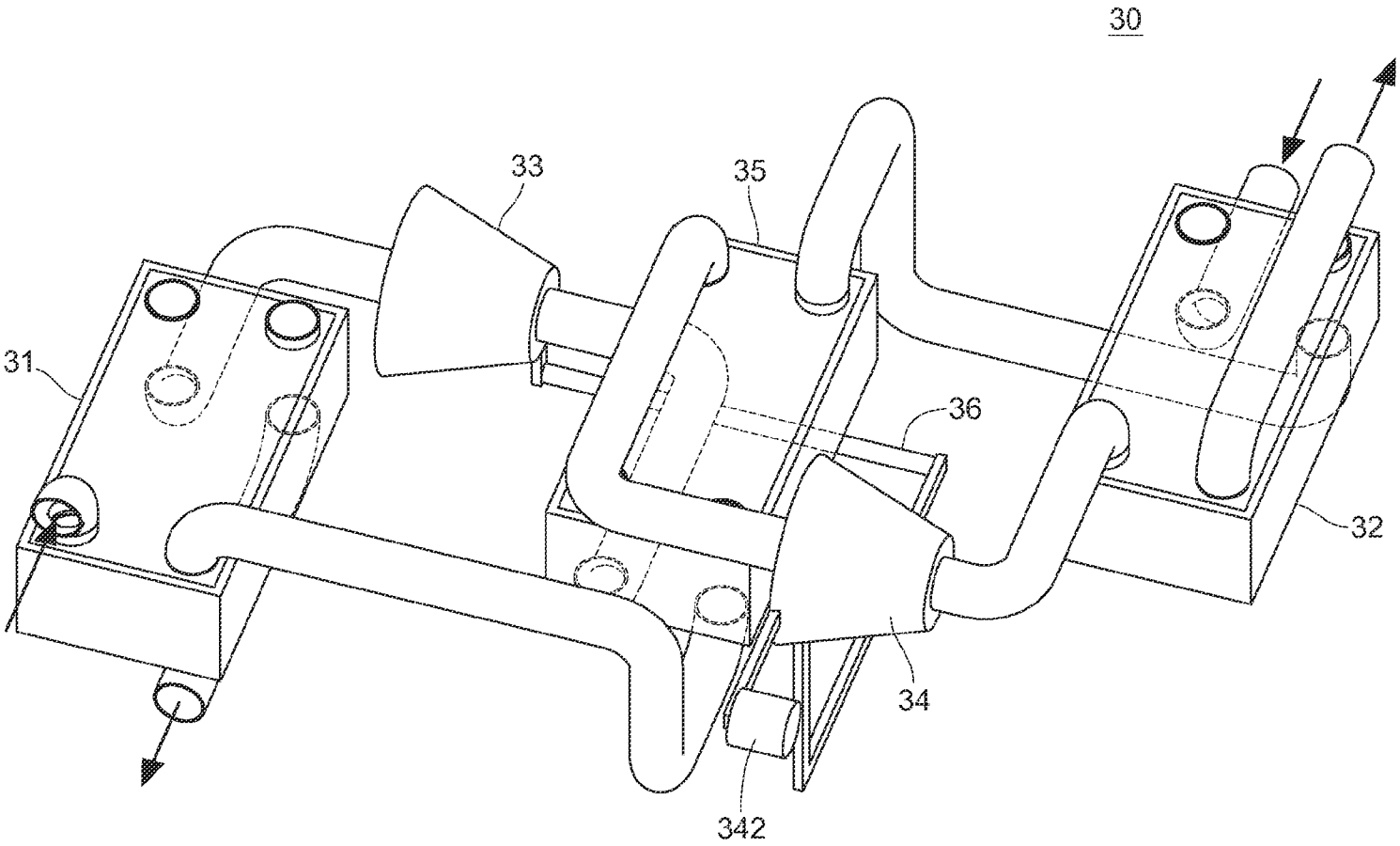
FIG. 3B is a three dimensional composite layout of the heat exchange circulation system illustrated in FIG. 3A.
Figure 3C:
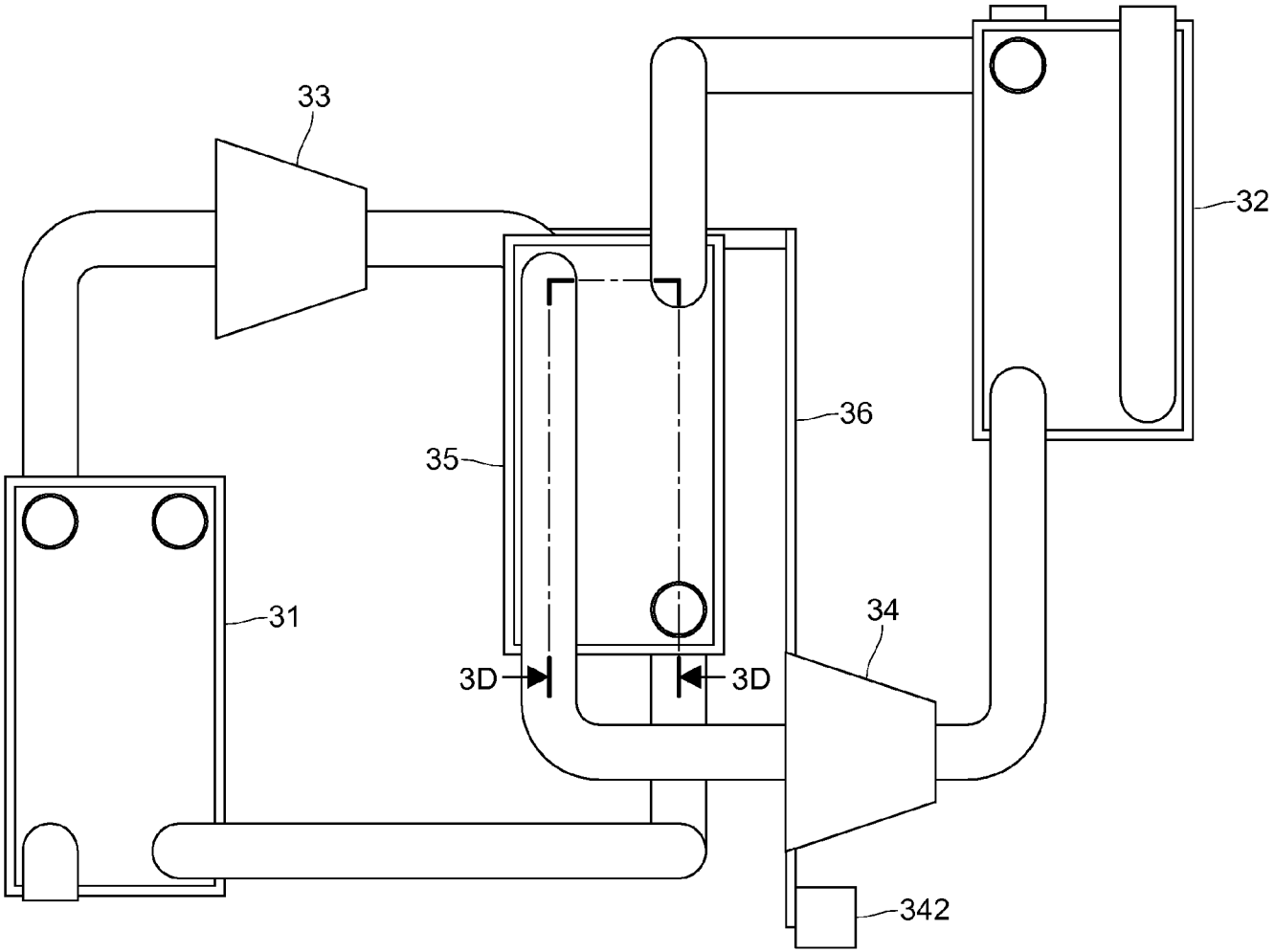
FIG. 3C is a top view of the heat exchange circulation system illustrated in FIG. 3B.

With reference to FIGS. 3A, 3B and 3C, FIG. 3A is a schematic view of another embodiment of a heat exchange circulation system 30 of the present disclosure, FIG. 3B is a three dimensional composite layout of the heat exchange circulation system 30 illustrated in FIG. 3A, and FIG. 3C is a top view of the heat exchange circulation system 30 illustrated in FIG. 3B. The heat exchange circulation system 30 includes a first heat exchanger 31, a second heat exchanger 32, an expansion device 33, a compressor 34 and a third heat exchanger 35. There are a first flow path 311 and a heat absorbing pipe 312 in the first heat exchanger 31. The first flow path 311 has a first gas inlet 311*a* and a first gas outlet 311*b*. There are a second flow path 321 and a heat dissipating pipe 322 in the second heat exchanger 32. The second flow path 321 has a second gas inlet 321*a* and a second gas outlet 321*b*. The third heat exchanger 35 includes a third flow path 351 and a fourth flow path 352 that are thermally connected to each other. The third flow path 351 has a third gas inlet 351*a* and a third gas outlet 351*b* whereas the fourth flow path 352 has a fourth gas inlet 352*a* and a fourth gas outlet 352*b*. The expansion device 33 has an expansion pipe 331. The compressor 34 has a compression pipe 341 that is connected to the second gas inlet 321*a*. The third flow path 351 is located between the first flow path 311 and the compressor 34. The compression pipe 341 is connected to the first gas outlet 311*b* through the third flow path 351 where the third gas inlet 351*a* is connected to the first gas outlet 311*b* and the third gas outlet 351*b* is connected to the compression pipe 341. The fourth flow path 352 is located between the second flow path 321 and the expansion device 33. The expansion pipe 331 that is connected to the first gas inlet 311*a*, is connected to the second gas outlet 321*b* through the fourth flow path 352, where the fourth gas inlet 352*a* is connected to the second gas outlet 321*b* and the fourth gas outlet 352*b* is connected to the expansion pipe 331.

In the present embodiment, the first flow path 311, the third flow path 351, the compression pipe 341, the second flow path 321, fourth flow path 352, and the expansion pipe 331 form a heat exchange circuit. The heat exchange circuit has a fluid flowing inside. The fluid includes a liquid and a gas mixture. The liquid is inside the first flow path 311, second flow path 321, the third flow path 351, and the fourth flow path 352. The gas mixture circulates within the heat exchange circuit. The first flow path 311 is in thermal contact with and exchanges heat with the heat absorbing pipe 312, but there is no direct fluid flow between these two conduits. The second flow path 321 is in thermal contact with and exchanges heat with the heat dissipating pipe 322, but there is no direct fluid flow between these two conduits. The third flow path 351 is in thermal contact with and exchanges heat with the fourth flow path 352, but there is no direct fluid flow between these two conduits.

In the present embodiment, the heat exchange circulation system 30 also includes a transmission device 36. The compressor 34 is connected to a motor 342 in order to compress the gas mixture. The transmission device 36 forwards the work, done by the gas mixture to the expansion device 33 during the expansion process, to the compressor 34, so that compressor 34 can compress the gas mixture with less energy output from the motor 342.

In the present embodiment, the heat absorbing pipe 312 has a heat absorbing inlet 312*a* and a heat absorbing outlet 312*b*. The heat dissipating pipe 322 has a heat dissipating inlet 322*a* and a heat dissipating outlet 322*b*. The medium that is desired to be cooled is fed through the heat absorbing inlet 312*a* into the heat absorbing pipe 312 to release heat before the medium departs the heat absorbing pipe 312 from the heat absorbing outlet 312*b*. The medium that is desired to be heated can be fed through the heat dissipating inlet 322*a* into the heat dissipating pipe 322 to absorb heat before the medium departs the heat dissipating pipe 322 from the heat dissipating outlet 322*b*.

In the present embodiment, for example, the liquid is water and the gas mixture is a mixture of water vapor and air. Prior to entering the expansion device 33, the gas mixture A3 is a gas mixture of saturated water vapor and air. The gas mixture A3 in the expansion pipe 331 expands while passing through the expansion device 33 and becomes a gas mixture of water vapor and air B3 that has lower temperature and less pressure than those of gas mixture A3.

Owing to the heat exchange between the first flow path 311 and the heat absorbing pipe 312, after the gas mixture B3 enters the first flow path 311 through the first gas inlet 311*a*, the gas mixture B3 absorbs the heat from the medium that is supposed to be cooled in the heat absorbing pipe 312. In addition, the liquid water inside the first flow path 311 also absorbs the heat from the medium, that is supposed to be cooled in the heat absorbing pipe 312, and becomes water vapor. Therefore, the gas mixture C3 released from the first flow path 311 through the first gas outlet 311*b* is a gas mixture of saturated water vapor and air whose temperature is higher than that of gas mixture B3.

Owing to the heat exchange between the third flow path 351 and the fourth flow path 352, after the gas mixture C3 enters the third flow path 351 through the third gas inlet 351*a*, the gas mixture C3 absorbs the heat from the gas mixture and the liquid water that are supposed to be cooled in the fourth flow path 352. In addition, the liquid water inside the third flow path 351 also absorbs the heat from the gas mixture and the liquid water in the fourth flow path 352, and becomes water vapor. Therefore, the gas mixture C3' released from the third flow path 351 through the third gas outlet 351*b* becomes a gas mixture of saturated water vapor and air whose temperature is higher than that of gas mixture C3.

The gas mixture C3' entering the compression pipe 341 undergoes an adiabatic or near adiabatic compression process carried out by the compressor 34. Thus, the gas mixture D3, released from the compression pipe 341, is a gas mixture of unsaturated water vapor and air with higher temperature and pressure than those of gas mixture C3'.

Owing to the heat exchange between the second flow path 321 and the heat dissipating pipe 322, after the gas mixture D3 enters the second flow path 321 through the second gas inlet 321*a*, the gas mixture D3 dissipates its heat to the medium that is supposed to be heated in the heat dissipating pipe 322. In addition, the heat of the gas mixture D3 is further reduced when the water vapor of the gas mixture D3 is condensed to liquid water inside the second flow path 321. Thus, the gas mixture A3' released from the second flow path 321 through the second gas outlet 321*b* becomes a gas mixture of saturated water vapor and air.

Owing to the heat exchange between the fourth flow path 352 and the third flow path 351 and the temperature of the gas mixture A3' being higher than that of the gas mixture C3, after the gas mixture A3' enters the fourth flow path 352 through the fourth gas inlet 352*a*, the gas mixture A3' dissipates its heat to the gas mixture and liquid water in the third flow path 351. In addition, the heat of the gas mixture A3' is further reduced when the water vapor of the gas mixture A3' is condensed to liquid water inside the fourth flow path 352. Thus, the gas mixture A3 released from the fourth flow path 352 through the fourth gas outlet 352*b* becomes a gas mixture of saturated water vapor and air having a temperature lower than that of the gas mixture A3'.

In the present embodiment, the liquid water in the first flow path 311 and the third flow path 351 can be refilled with outer water. The liquid water in the second flow path 321 and the fourth flow path 352 can be discharged outside the heat exchange circulation system 30, but not limited to the disclosure. In the present embodiment, the structures of the first heat exchanger 31 and the first heat exchanger 11 illustrated in FIG. 1C are identical, thus no further descriptions are provided. The structures of the second heat exchanger 32 and the second heat exchanger 12 illustrated in FIG. 1C are identical, thus no further descriptions are provided.

Figure 3D:
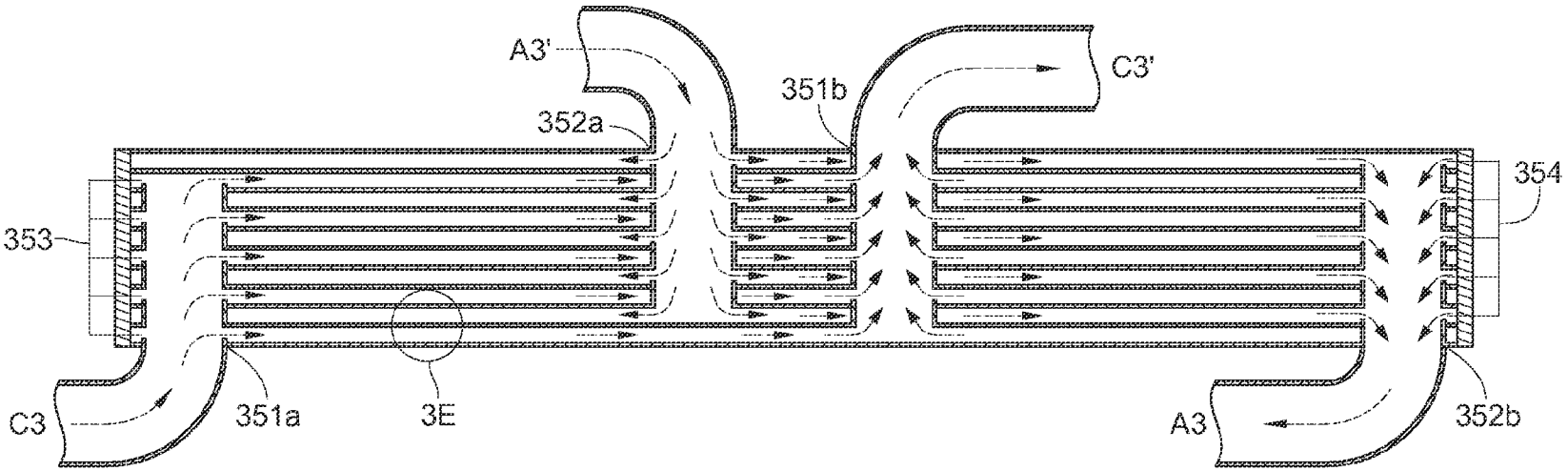
FIG. 3D is a sectional schematic view of the third heat exchanger shown in FIG. 3C along the 3D-3D cutting plane line.
Figure 3E:
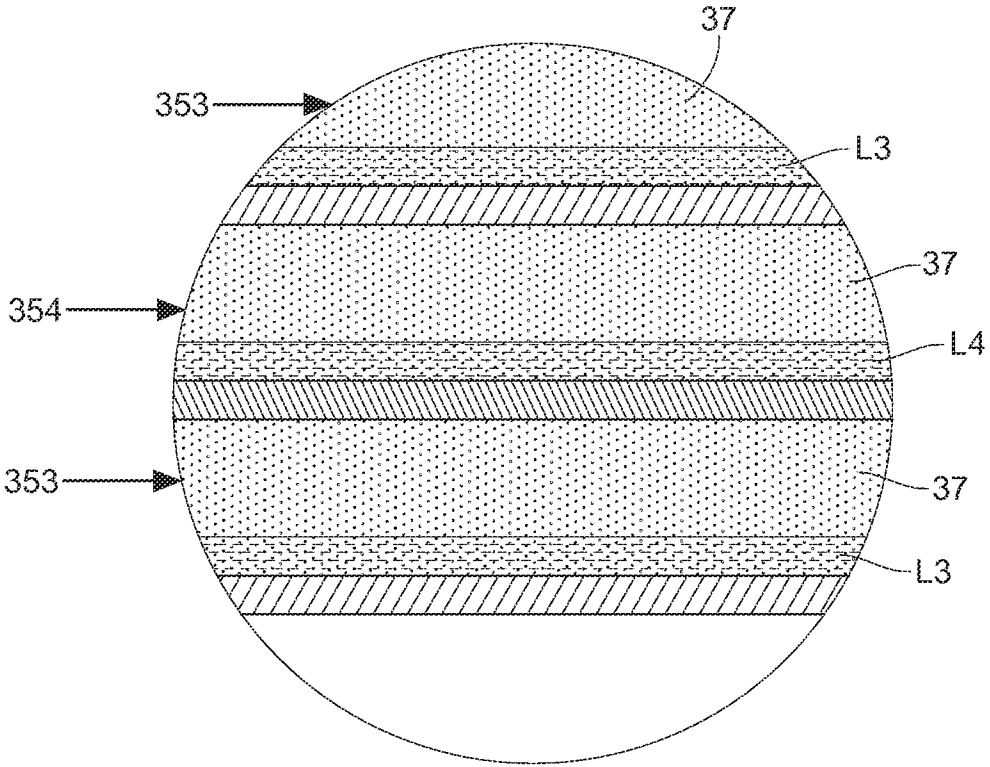
FIG. 3E is a partially enlarged section view of an area shown in FIG. 3D.

With reference to FIGS. 3D and 3E, FIG. 3D is a sectional schematic view of the third heat exchanger 35 in FIG. 3C along the line 3D-3D, while FIG. 3E is a partially enlarged section view of an area shown in FIG. 3D. The third heat exchanger 35 is a plate type heat exchanger, which is composed of multiple, thin, slightly separated plates orderly stacked together, to provide a plurality of heat exchange regions in which the gas mixture of water vapor and air, and liquid water L3 and L4 flow. The odd-numbered heat exchange space 353 represented by odd-numbered heat exchange regions located from the bottom forms the third flow path 351 illustrated in FIG. 3A and the heat exchange space 354 represented by even-numbered heat exchange regions located from the bottom forms the fourth flow path 352 as illustrated in FIG. 3A. The gas mixture C3 that enters the odd-numbered regions of odd-numbered heat exchange space 353 from the third gas inlet 351*a* is converted to the gas mixture C3' before exits the odd-numbered heat exchange space 353 through the third gas outlet 351*b*. In addition, the odd-numbered heat exchange space 353 has liquid water L3 and the even-numbered heat exchange space 354 has liquid water L4. The gas mixture A3' enters the even-numbered heat exchange space 354 through the heat dissipating inlet 352*a* and exits the even-numbered heat exchange space 354 through the heat dissipating outlet 352*b*.

The temperatures of the gas mixture A3' and liquid water L4 in the even-numbered heat exchange space 354 are higher than those of the gas mixture C3 and liquid water L3 in the odd-numbered heat exchange space 353. Thus, heat is transferred from the gas mixture A3' and liquid water L4 to the gas mixture C3 and liquid water L3, as a result, reducing the temperatures of the gas mixture A3' and liquid water L4. As the water vapor of the gas mixture A3' is condensed to liquid water L4 while releasing the heat, its remaining gas mixture forms the gas mixture A3. Due to absorption of the heat, the temperatures of the gas mixture C3 and the liquid water L3 increase and the liquid water L3 is evaporated to water vapor, that is mixed with the gas mixture C3 to form the gas mixture C3'.

Therefore, the proposed disclosure utilizes the third heat exchanger 35 to reduce the temperature of the gas mixture A3, prior to entering the expansion device 33, to be lower than that of the gas mixture A3'. Consequently, such act reduces the temperature of the gas mixture B3 that enters the first flow path 311 further, leading to a better heat exchange effect by widening the temperature difference between the gas mixture B3 and the medium to be cooled. The proposed disclosure utilizes the third heat exchanger 35 to increase the temperature of the gas mixture C3', prior to entering the compressor 34, to be higher than that of the gas mixture C3. Consequently, such act increases the temperature of the gas mixture D3 that enters the second flow path 321 further, leading to a better heat exchange effect by widening the temperature difference between the gas mixture D3 and the medium to be heated.

The heat exchange circulation system 30 shown in FIG. 3B also includes a plurality of porous heat transfer medium 37. As illustrated in FIG. 3E, the porous heat transfer medium 37 is installed in the odd-numbered heat exchange space 353 that form the third flow path 351, and in the even-numbered heat exchange space 354 that form the heat absorbing pipe 312. The porous heat transfer medium 37 can be, for example, a metal foam. The porous heat transfer medium 37 with intercommunicated holes allows the gas mixture A3, A3', C3 and C3 passing through itself. Since the porous heat transfer medium 37 has larger surface, the condensation rate and the heat exchange efficiency are improved.

Figure 4A:
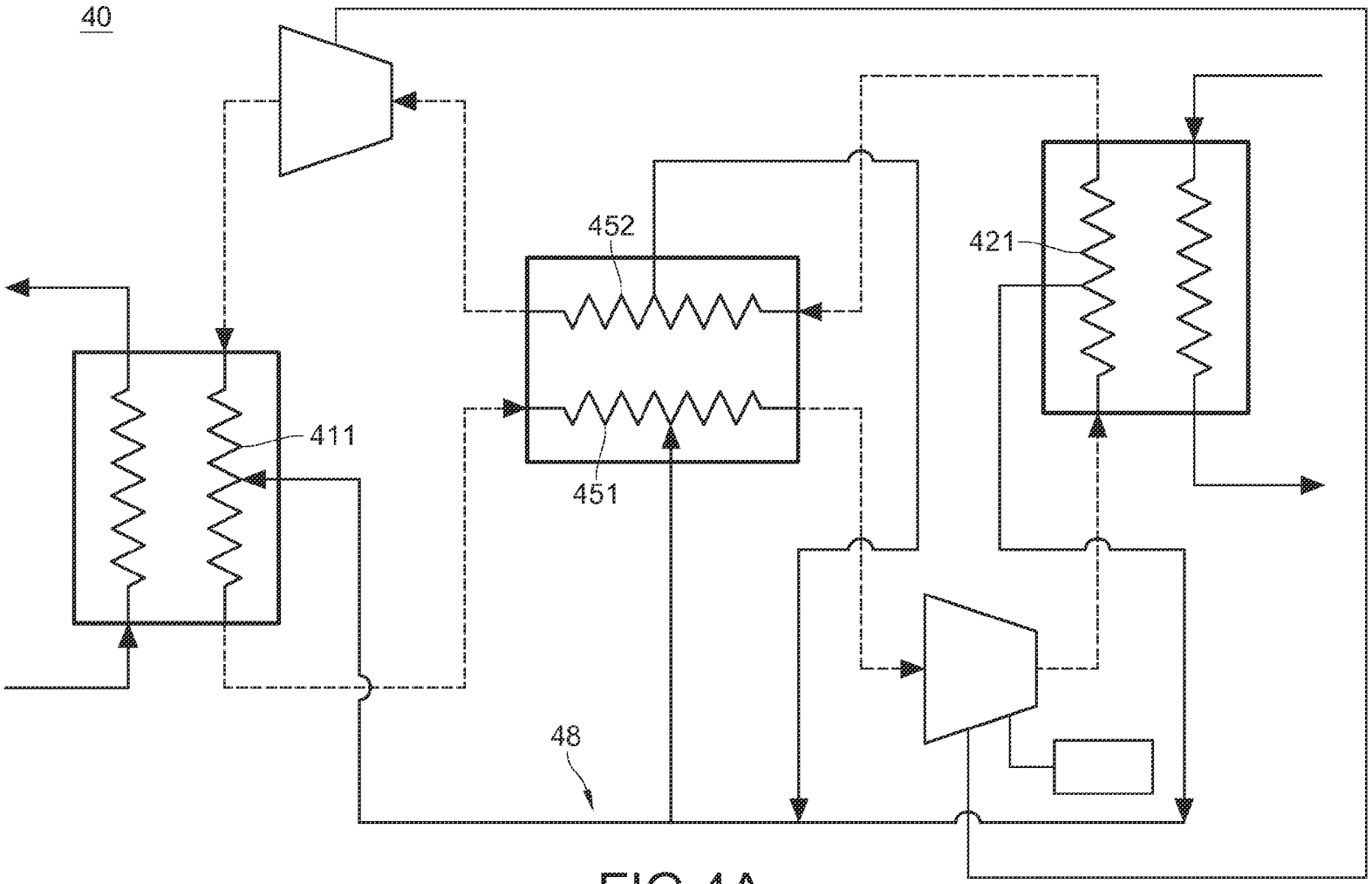
FIG. 4A is a schematic view of another embodiment of a heat exchange circulation system of the present disclosure.
Figure 4B:
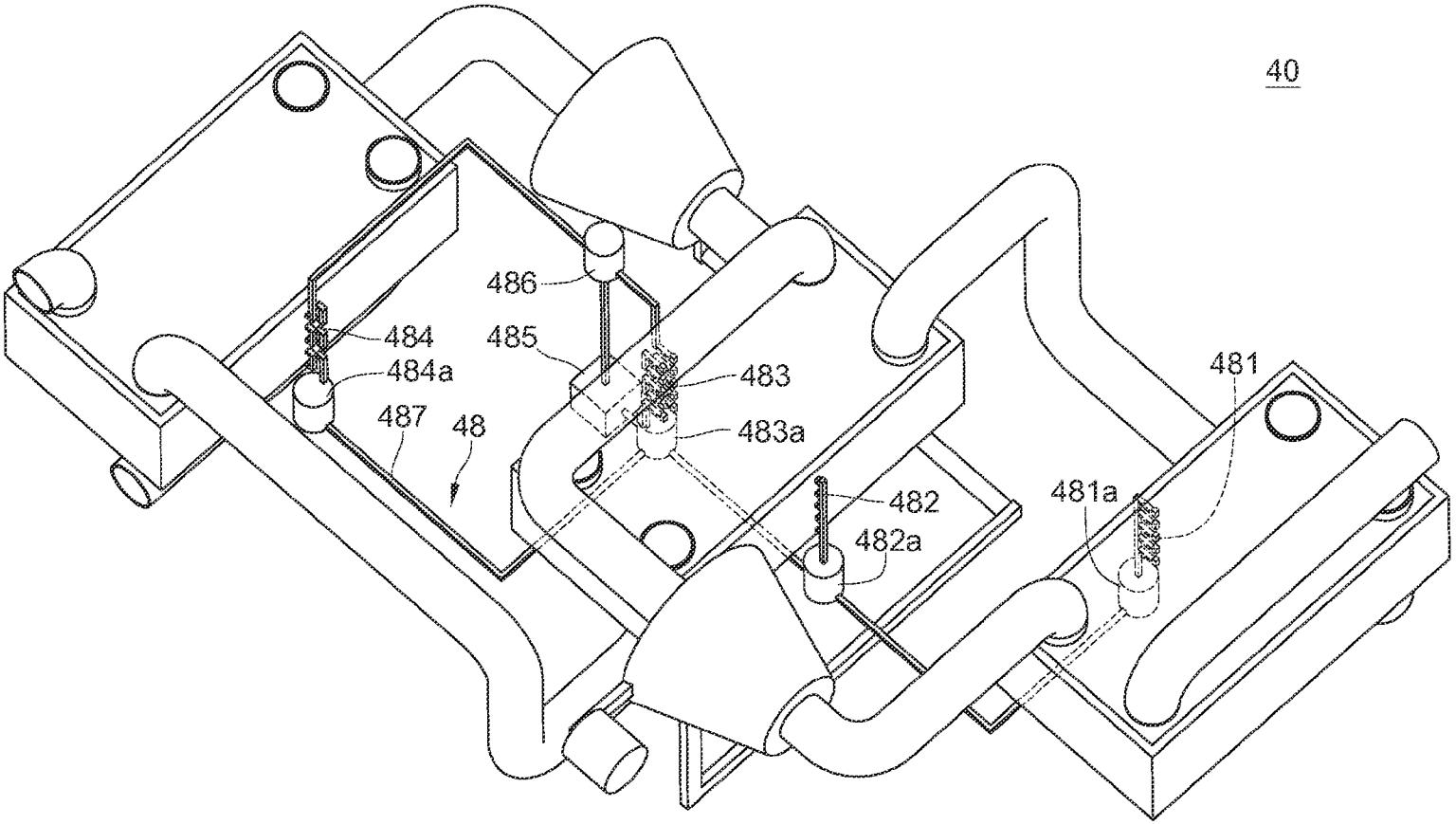
FIG. 4B is a three dimensional composite layout of the heat exchange circulation system illustrated in FIG. 4A.

With reference to FIGS. 4A and 4B, FIG. 4A is a schematic view of another embodiment of a heat exchange circulation system 40 of the present disclosure; FIG. 4B is a three dimensional composite layout of the heat exchange circulation system 40 illustrated in FIG. 4A. In the present embodiment, the heat exchange circulation system 40 is similar to the heat exchange circulation system 30 shown in FIG. 3A. However, the heat exchange circulation system 40 of this embodiment further includes a liquid return line 48. The liquid return line 48 is connected to the first flow path 411, the second flow path 421, the third flow path 451 and the fourth flow path 452. Liquid from the second flow path 421 and the fourth flow path 452 is directed to the first flow path 411 and the third flow path 451 through the liquid return line 48 in order to balance the liquid volumes among the first flow path 411, the second flow path 421, the third flow path 451 and the fourth flow path 452.

For example, the liquid return line 48 includes a first collection tube 481, a first liquid collection container 481*a*, a second collection tube 482, a second liquid collection container 482*a*, a first distribution tube 483, a third liquid collection container 483*a*, a second distribution tube 484, a fourth liquid collection container 484*a*, a pump 485, a distribution container 486 and an overflow tube 487. The first collection tube 481 gathers the liquid in the second flow path 421 into the first liquid collection container 481*a* while the second collection tube 482 gathers the liquid in the fourth flow path 452 into the second liquid collection container 482*a*. Eventually, the liquid in the first liquid collection container 481*a* and the second liquid collection container 482*a* is forwarded to the third liquid collection container 483*a*. The collected liquid in the third liquid collection container 483*a* then is pumped to the distribution container 486 and is distributed through the first distribution tube 483 and the second distribution tube 484 into the third flow path 451 and the second distribution tube 484, respectively. The residual liquid from the first distribution tube 483 is routed back to the third liquid collection container 483*a* whereas the residual liquid from the second distribution tube 484 is forwarded first back to the fourth liquid collection container 484*a*, then to the third liquid collection container 483*a* through the overflow tube 487. Thus, the excess liquid in the second flow path 421 and the fourth flow path 452 is fed to the first flow path 411 and the third flow path 451 through the liquid return line 48.

Figure 5A:
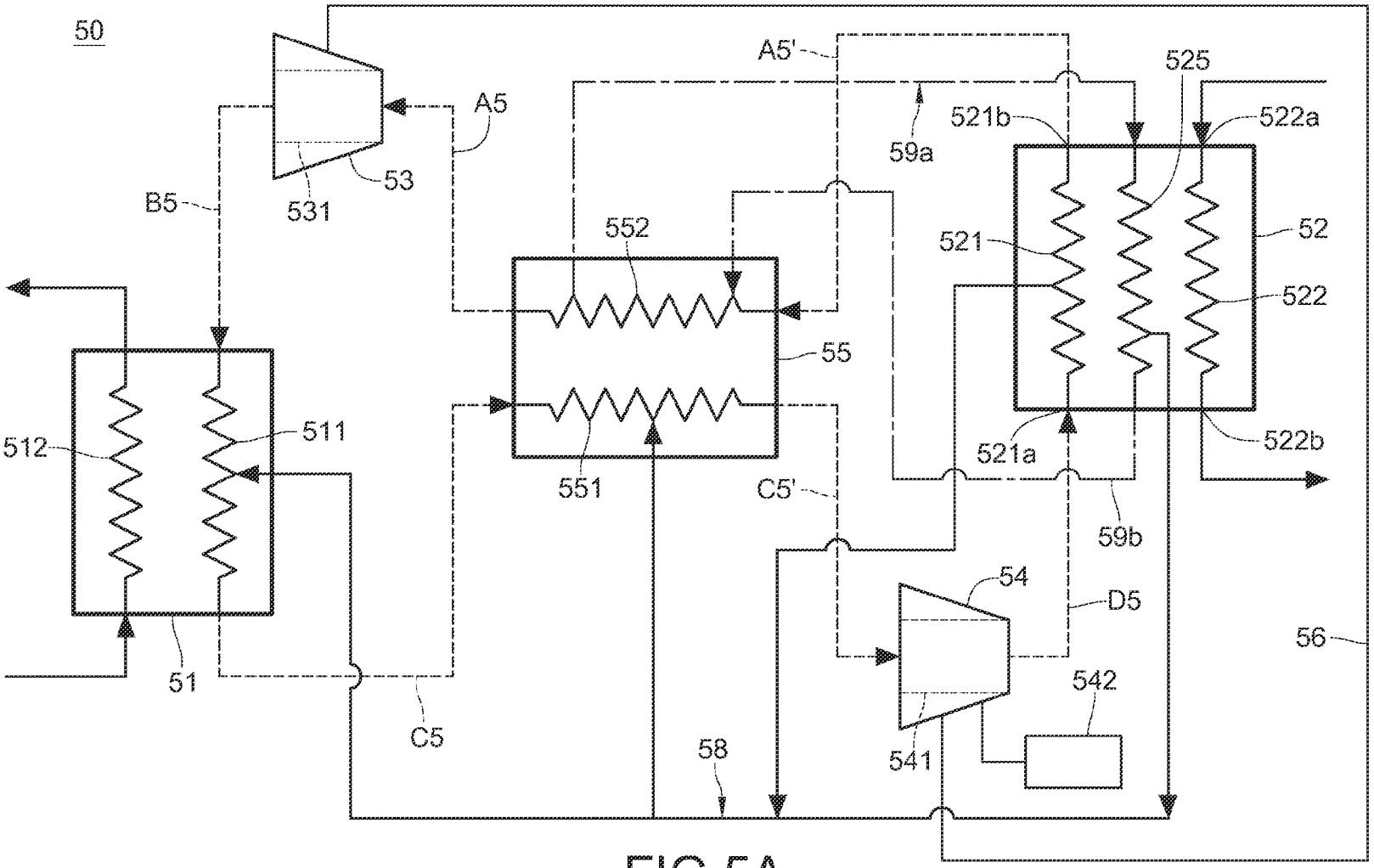
FIG. 5A is a schematic view of another embodiment of a heat exchange circulation system of the present disclosure.
Figure 5B:
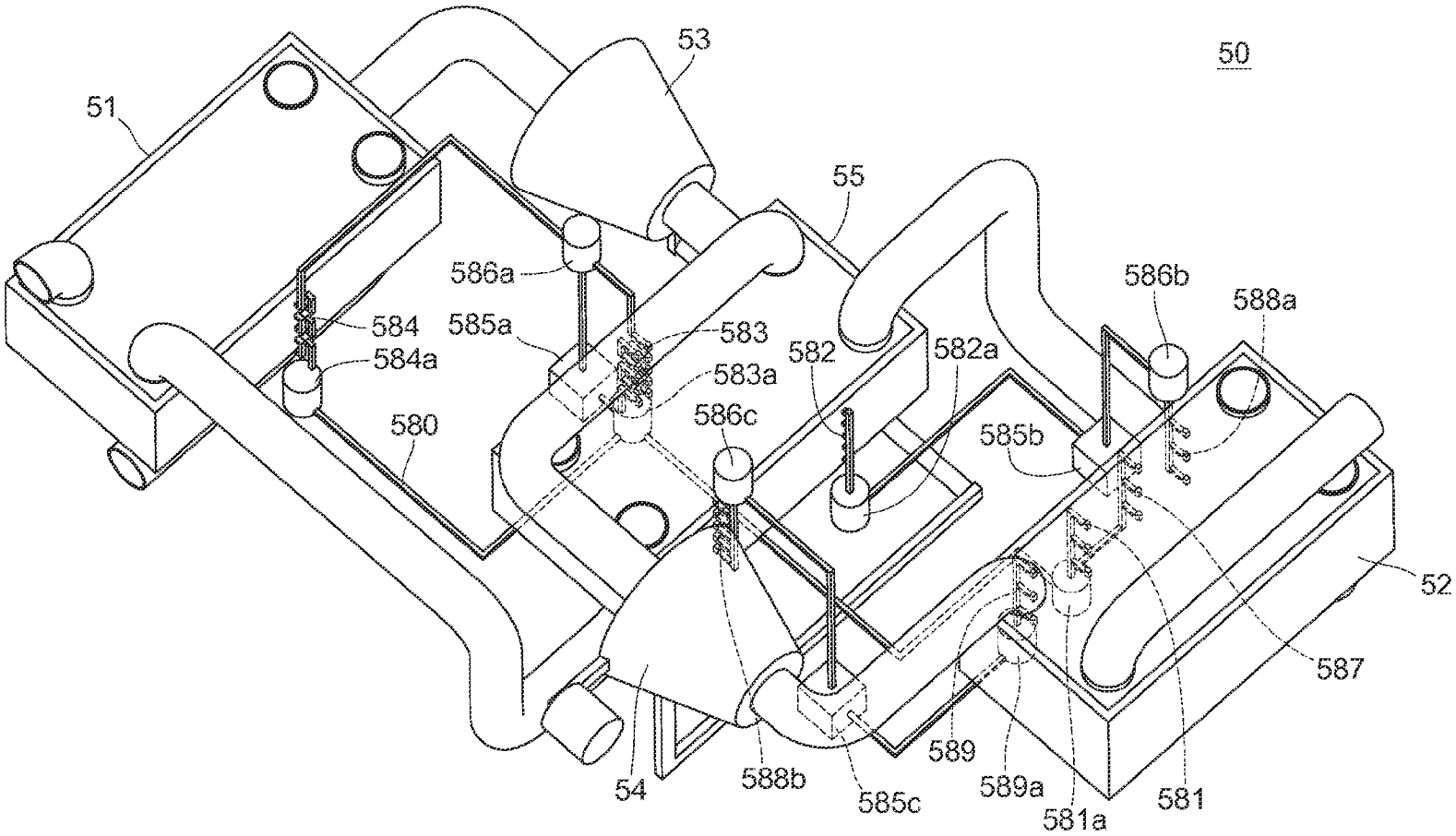
FIG. 5B is a three dimensional composite layout of the heat exchange circulation system illustrated in FIG. 5A.
Figure 5C:
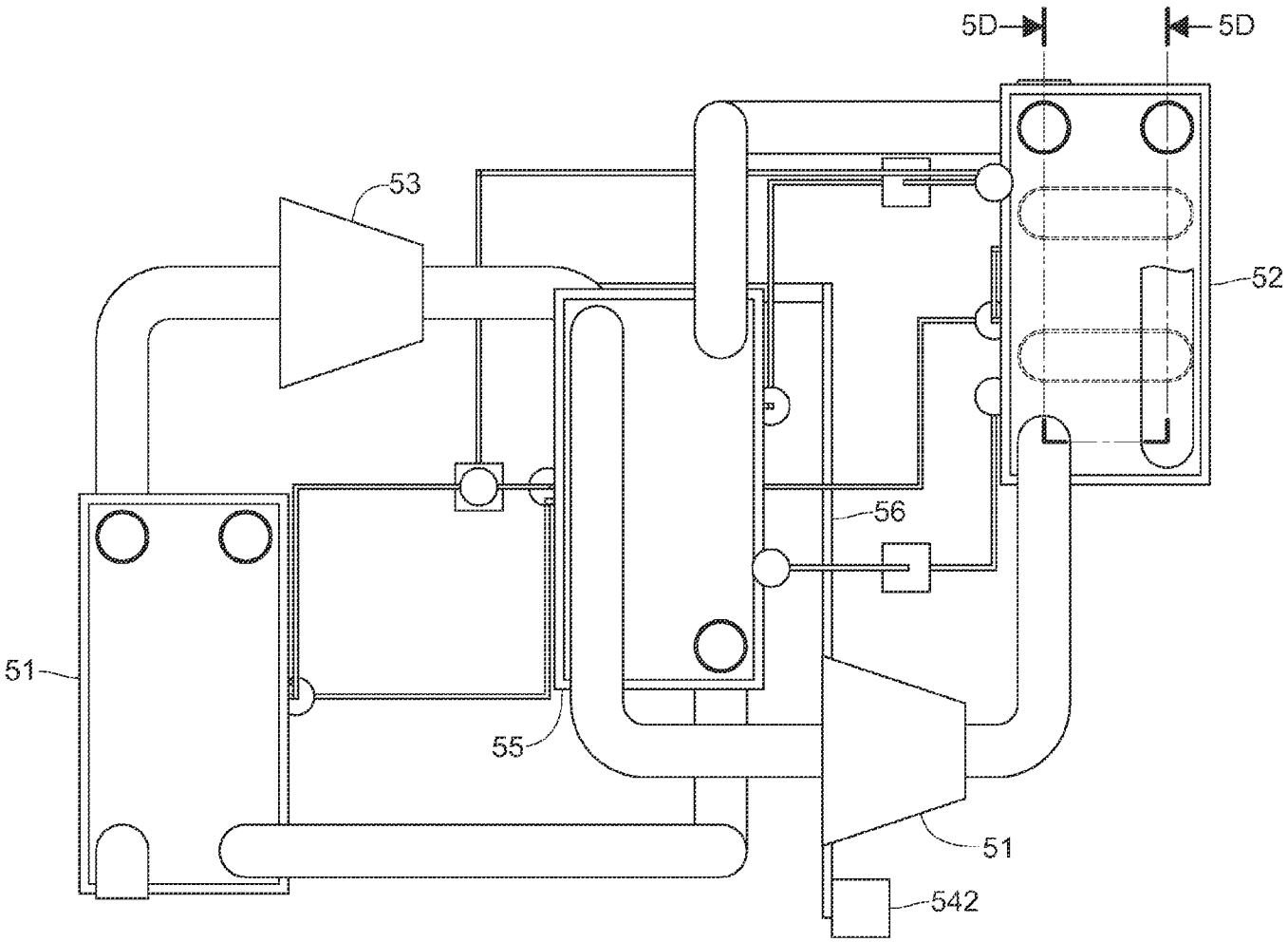
FIG. 5C is a top view of the heat transfer circulation system described in FIG. 5B.

With reference to FIGS. 5A, 5B and 5C, FIG. 5A is a schematic view of another embodiment of a heat exchange circulation system 50 of the present disclosure; FIG. 5B is a three dimensional composite layout of the heat exchange circulation system 50 illustrated in FIG. 5A; FIG. 5C is a top view of the embodiment of the heat transfer circulation system 50 of the present disclosure described in FIG. 5B. The heat transfer circulation system 50 includes a first heat exchanger 51, a second heat exchanger 52, an expansion device 53, a compressor 54 and a third heat exchanger 55. Inside the first heat exchanger 51, there are a first flow path 511 and a heat absorbing pipe 512. Inside the second heat exchanger 52, a second flow path 521, a fifth flow path 525 and a heat dissipating pipe 522 are in thermal contact with each other. The third heat exchanger 55 includes a third flow path 551 and a fourth flow path 552 that are in thermal contact with each other. The expansion device 53 has an expansion pipe 531. The compressor 54 has a compression pipe 541. The first flow path 511, the third flow path 551, the compression pipe 541, the second flow path 521, the fourth flow path 552 and the expansion pipe 531 together form a heat exchange circuit. The second flow path 521 has a second gas inlet 521*a* and a second gas outlet 521*b*. The heat dissipating pipe 522 has a heat dissipating inlet 522*a* and a heat dissipating outlet 522*b*.

In the present embodiment, the heat exchange circuit has a fluid flowing inside it. The fluid includes a liquid and a gas mixture. The liquid is inside the first flow path 511, second flow path 521, the third flow path 551, and the fourth flow path 552. The heat exchange circulation system 50 also includes a non-volatile solute. The non-volatile solute dissolved in the liquid to form a solution inside the fourth flow path 552. The non-volatile solute, for example, is salt, bromide salt, or other kind of salt. The gas mixture circulates within the heat exchange circuit. The first flow path 511 and the heat absorbing pipe 512 are in thermal contact with and exchange heat with each other, but there is no direct fluid flow between them. The second flow path 521, the fifth flow path 525 and the heat dissipating pipe 522 are in thermal contact with and exchange heat with one another, but there is no direct fluid flow among these three conduits. The third flow path 551 and the fourth flow path 552 are in thermal contact with and exchange heat with each other, but there is no direct fluid flow between these two conduits.

In the present embodiment, the heat exchange circulation system 50 further includes a transmission device 56. The compressor 54 is connected to a motor 542 in order to compress the gas mixture. The transmission device 56 forwards the work, done by the gas mixture to the expansion device 53 during the expansion process, to the compressor 54, so that compressor 54 can compress the gas mixture with less energy output from the motor 542.

In the present embodiment, the medium that is desired to be cooled is fed into the heat absorbing pipe 512 to release heat, and the medium departs the heat absorbing pipe 512 afterward. The medium that is desired to be heated can be fed into the heat dissipating pipe 522 to absorb heat then the medium departs the heat dissipating pipe 522 afterward.

In the present embodiment, for example, the liquid is water and the gas mixture is a mixture of water vapor and air. The gas mixture is a mixture of unsaturated water vapor and air A5 prior to entering the expansion device 53. The temperature of the gas mixture A5 can be 293K at a pressure of 0.2 atmosphere (atm) with a relative humidity of 74%. The gas mixture A5 in the expansion pipe 531 expands while passing through the expansion device 53 and becomes the gas mixture B5 that has lower temperature and less pressure than those of gas mixture A5 . The pressure of the gas mixture B5 is 0.13 atm. Owing to the heat exchange between the first flow path 511 and the heat absorbing pipe 512, after the gas mixture B5 enters the first flow path 511, the gas mixture B5 absorbs the heat from the medium that is supposed to be cooled in the heat absorbing pipe 512. In addition, the liquid water inside the first flow path 511 also absorbs the heat from the medium, which is supposed to be cooled in the heat absorbing pipe 512, and becomes water vapor. Therefore, the gas mixture C5 released from the first flow path 511 is a gas mixture of saturated water vapor and air whose temperature is higher than that of gas mixture B5. The temperature of the gas mixture C5 can be 293K at a pressure of 0.13 atm with a relative humidity of 100%.

Owing to the heat exchange between the third flow path 551 and the fourth flow path 552, after the gas mixture C5 enters the third flow path 551, the gas mixture C5 absorbs the heat from the gas mixture and liquid water in the fourth flow path 552. In addition, the liquid water inside the third flow path 551 also absorbs the heat from the gas mixture and liquid water in the fourth flow path 552, and becomes water vapor. Therefore, the gas mixture C5' released from the third flow path 551 is a gas mixture of saturated water vapor and air whose temperature is higher than that of gas mixture C5. The temperature of the gas mixture C5' can be 313K at a pressure of 0.13 atm with a relative humidity of 100%.

The gas mixture C5' in the compression pipe 541 undergoes an adiabatic or near adiabatic compression process carried out by the compressor 54. Thus, the gas mixture D5, released from the compression pipe 541, is a gas mixture of unsaturated water vapor and air with higher temperature and pressure than those of gas mixture C5'. The temperature of the gas mixture D5 can be 363K at a pressure of 0.2 atm.

Owing to the heat exchange between the second flow path 521 and the heat dissipating pipe 522, after the gas mixture D5 enters the second flow path 521, the gas mixture D5 dissipates its heat to the medium that is supposed to be heated in the heat dissipating pipe 522. In addition, the heat of the gas mixture D5 is further released when the water vapor of the gas mixture D5 is condensed to liquid water inside the second flow path 521. Thus, the gas mixture A5' released from the second flow path 521 becomes a gas mixture of saturated water vapor and air.

Owing to the heat exchange between the fourth flow path 552 and the third flow path 551 and the temperature of the gas mixture A5' being higher than that of the gas mixture C5, after the gas mixture A5' enters the fourth flow path 552, the gas mixture A5' dissipates its heat to the gas mixture and liquid water in the third flow path 551. In addition, the heat of the gas mixture A5' is further released when the water vapor of the gas mixture A5' is condensed to liquid water inside the fourth flow path 552. However, having the non-volatile solute dissolved in the liquid water in the fourth flow path 552, the liquid water becomes difficult to evaporate. Thus, the gas mixture A5 released from the fourth flow path 552 becomes a gas mixture of unsaturated water vapor and air having a temperature lower than that of the gas mixture A5'.

The heat exchange circulation system 50 of this embodiment also includes a dilute solution transmission line 59*a*, a concentrated solution return line 59*b* and a liquid return line 58. The dilute solution transmission line 59*a* is connected to the fourth flow path 552 and the fifth flow path 525. The solution in the fourth flow path 552 flows to the fifth flow path 525 through the dilute solution transmission line 59*a*, becomes a more concentrated solution by giving out partial liquid water during the distillation process in the fifth flow path 525, and returns to the fourth flow path 552 through the concentrated solution return line 59*b* thereafter. The concentration of the solution in the fourth flow path 552 in this embodiment is diluted from the increasing amount of liquid water condensed from the water vapor of the gas mixture A5' in the fourth flow path 552. However, by routing the solution in the fourth flow path 552 to the fifth flow path 525 through the dilute solution transmission line 59*a* for the distillation process, and by forwarding the processed solution back to the fourth flow path 552, allow the system to maintain the concentration of the solution in the fourth flow path 552.

The liquid return line 58 in this embodiment is connected to the first flow path 511, the second flow path 521, the third flow path 551 and the fifth flow path 525. Liquid water from the second flow path 521 and the liquid water condensed from the fifth flow path 525 is directed to the first flow path 511 and the third flow path 551 through the liquid return line 58 in order to balance the liquid volumes among the first flow path 511, the second flow path 521, the third flow path 551 and the fifth flow path 525.

For example, the liquid return line 58 includes a first collection tube 581, a first liquid collection container 581*a*, a second collection tube 582, a second liquid collection container 582*a*, a first distribution tube 583, a third liquid collection container 583*a*, a second distribution tube 584, a fourth liquid collection container 584*a*, a first pump 585*a*, a second pump 585*b*, a third pump 585*c*, a first liquid distribution container 586*a*, a second liquid distribution container 586*b*, a third liquid distribution container 586*c*, a third collection tube 587, a third distribution tube 588*a*, a fourth distribution tube 588*b*, a fourth collection tube 589, a fifth liquid collection container 589*a* and an overflow tube 580.

The first collection tube 581 gathers and forwards the liquid water from the second flow path 521 to the first liquid collection container 581*a*, the third collection tube 587 gathers and forwards the distilled liquid water from the fifth flow path 525 to the first liquid collection container 581*a*, and the collected liquid water is then forwarded from the first liquid collection container 581*a* to the third liquid collection container 583*a*. The liquid water in the third liquid collection container 583*a* is transferred by the first pump 585*a* to the first liquid distribution container 586*a*. The liquid water in the first liquid distribution container 586*a* is fed to the first distribution tube 583 and the second distribution tube 584. The liquid water in the first distribution tube 583 is fed to the third flow path 551 and the residual liquid water then returns to the third liquid collection contain 583*a*. The liquid water in the second distribution tube 584 is fed to the first flow path 511 and the residual liquid water then continuously travels to the fourth liquid collection container 584*a* and the overflow tube 580 until the residual liquid water reaches the third liquid collection container 583*a*. Therefore, the excess liquid water in the second flow path 521 and the liquid water distilled in the fifth flow path 525 is forwarded to the first flow path 511 and the third flow path 551 through the liquid return line 58.

The diluted solution in the fourth flow path 552 that passes through the second collection tube 582, is gathered in the second liquid collection container 582*a*, and is forwarded by the second pump 585*b* to the second liquid distribution container 586*b*. The diluted solution flows from the second liquid distribution container 586*b* to the third distribution tube 588*a* and continues to the fifth flow path 525 for concentration process.

The concentrated solution is then forwarded from the fifth flow path 525 to the fifth liquid collection container 589*a* through the fourth collection tube 589 and is pumped by the third pump 585*c* to the third liquid distribution container 586*c*. The concentrated solution in the third liquid distribution container 586*c* then passes through the fourth distribution tube 588*b* and returns to the fourth flow path 552 allowing the system to stabilize the concentration of the solution in the fourth flow path 552.

In the present embodiment, the structures of the first heat exchanger 51 and the first heat exchanger 11 illustrated in FIG. 1C are identical, thus no further descriptions are provided. The structures of the third heat exchanger 55 and the third heat exchanger 35 illustrated in FIG. 3C are identical, thus no further descriptions are provided.

Figure 5D:
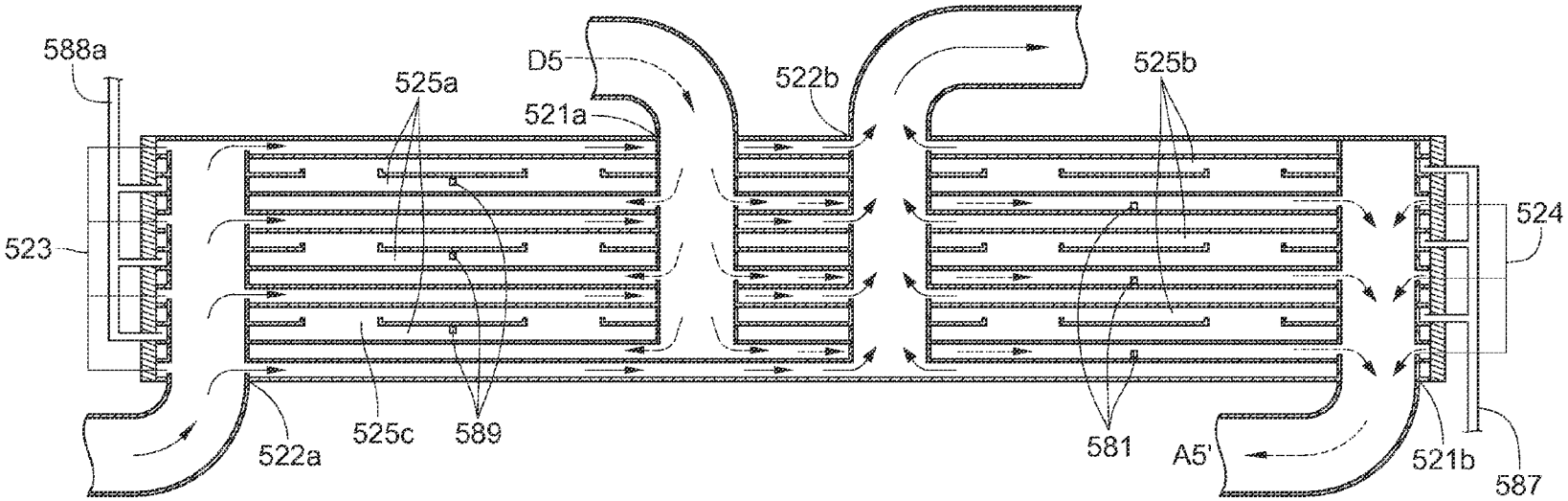
FIG. 5D is a sectional schematic view of the second heat exchanger shown in FIG. 5C along the 5D-5D cutting plane line.

With reference to FIG. 5D, FIG. 5D is a sectional schematic view of the second heat exchanger 52 shown in FIG. 5C along the line 5D-5D. The second heat exchanger 52 is a plate type heat exchanger, which is composed of multiple, thin, slightly separated plates orderly stacked together, to provide a plurality of heat exchange regions for the gas mixture of water vapor and air, the liquid water and the solution. The heat exchange space 523 represented by the heat exchange regions, whose numbered position from the bottom to be divided by 4 has a remainder value of 1, forms the heat dissipating pipe 522 illustrated in FIG. 5A. The heat exchange space 524 represented by the heat exchange regions, whose numbered position from the bottom to be divided by 4 has a remainder value of 2, forms the second flow path 521 illustrated in FIG. 5A. The heat exchange space 525*a* represented by the heat exchange regions, whose numbered position from the bottom to be divided by 4 has a remainder value of 3 and is connected to the third distribution tube 588*a* and the fourth collection tube 589, and the heat exchange space 525*b* represented by the heat exchange regions, whose numbered position from the bottom to be divided by 4 has a remainder value of 0 and is connected to the third collection tube 587, together form the fifth flow path 525 illustrated in FIG. 5A. There is a through hole 525*c* that connects both the heat exchange space 525*a* and the heat exchange space 525*b*. The gas mixture D5 enters the heat exchange space 524 through the second gas inlet 521*a* and is converted to the gas mixture A5' prior to departing the heat exchange space 524 through the second gas outlet 521*b*. In addition, the liquid water flows inside the heat exchange space 524. The medium to be heated enters the heat exchange space 523 through the heat dissipating inlet 522*a* and departs the heat exchange space 523 through the heat dissipating outlet 522*b*. The diluted solution is forwarded to the heat exchange space 525*a* from the third distribution tube 588*a* and flows from the heat exchange space 525*a* to the fourth collection tube 589 thereafter.

The temperature of the medium to be heated in the heat exchange space 523 and the temperature of the diluted solution in the heat exchange space 525*a* are lower than those of the gas mixture D5 and liquid water in the heat exchange space 524. Thus, heat is transferred from the gas mixture D5 and liquid water to the medium to be heated and the diluted solution, as a result, increasing the temperature of the medium to be heated and the diluted solution. When temperature of the diluted solution increases, according to the distillation effect, the diluted solution releases the water vapor that flows through the through hole to the heat exchange space 525*b*. The water vapor, that reaches the heat exchange space 525*b*, is condensed to the liquid water due to the effect attributed from the lower temperatures in the heat exchange space 523 that is adjacent to the heat exchange space 525*b*, and is led to the first liquid collection container 581*a* through the third collection tube 587. After releasing the water vapor during the distillation process, the solution in the heat exchange space 525*a* becomes the concentrated solution that eventually flows back to the fifth liquid collection container 589*a* through the fourth collection tube 589.

The temperature of the gas mixture D5 in the heat exchange space 524 decreases after the gas mixture D5 releases heat and the water vapor of the gas mixture D5 is condensed to the liquid water upon giving away the heat. The remaining gas mixture becomes the gas mixture A5' and the condensed liquid water return to the first liquid collection container 581*a* through the first collection tube 581.

In summary, the heat exchange circulation system of the present disclosure applies the feature that the gas temperature drops due to gas expansion characteristics, and feed the gas of lower temperature to the first flow path for absorbing heat. According to the fact that the temperature of the gas mixture increases when the gas mixture undergoes an adiabatic or near adiabatic compression process, the gas of higher temperature before passes through the second flow path releases heat in the second flow path. By applying the feature that the liquid absorbs heat during evaporation, liquid is evaporated in the first flow path in order to obtain heat absorption. By applying the feature that the vapor releases heat during condensation, vapor is condensed in the second flow path to release heat. The implementations of the evaporation and condensation between the liquid and the vapor described above increase the heat transfer efficiency of the heat exchange circulation system. In addition, adding the third heat exchanger to widen the temperature difference between the gas mixture and the medium to be cooled in the first heat exchanger and to widen the temperature difference between the gas mixture and the medium to be heated in the second heat exchanger can increase the heat transfer efficiency of the heat exchange circulation system. Furthermore, adding the non-volatile solute in the liquid to reduce the water vapor released during the evaporation and to have less water vapor in the gas mixture prior to entering the expansion device, helps converting the liquid to the vapor during the evaporation in the first flow path and increases the heat exchange efficiency.

What is claimed is:

1. A heat exchange circulation system, comprising:

a first heat exchanger which includes a first flow path that has a first gas inlet and a first gas outlet;

a second heat exchanger which includes a second flow path that has a second gas inlet and a second gas outlet;

a third heat exchanger which includes a third flow path, and a fourth flow path in thermal contact with the third flow path, the third flow path has a third gas inlet and a third gas outlet, the fourth flow path has a fourth gas inlet and a fourth gas outlet, the third gas inlet is connected to the first gas outlet, the fourth gas inlet is connected to the second gas outlet:

an expansion device which includes an expansion pipe that is connected to the fourth gas outlet and the first gas inlet; and a compressor which includes a compression pipe that is connected to the third gas outlet and the second gas inlet;

wherein the first flow path, the third flow path, the compression pipe, the second flow path, the fourth flow path and the expansion pipe together form a heat exchange circuit, the heat exchange circuit has a fluid medium flowing within it, the fluid medium includes a liquid and a gas mixture, the liquid exists in the first flow path, the second flow path, the third flow path and the fourth flow path, and the gas mixture circulates in the heat exchange circuit; and the first flow path, the second flow path, the third flow path and the fourth flow path are connected by a liquid return line, which delivers the liquid from the second flow path and the fourth flow path to the first flow path and the third flow path.

2. The heat exchange circulation system according to claim 1, wherein the first heat exchanger is a plate type heat exchanger for the heat exchange between the first flow path and a heat absorbing pipe.

3. The heat exchange circulation system according to claim 2, wherein the first heat exchanger includes multiple separated plates stacked together to provide a plurality of heat exchange regions among which those represented by odd-numbered heat exchange regions forms either the first flow path or the heat absorbing pipe, and those represented by even-numbered heat exchange regions forms the remainder of the first flow path or the heat absorbing pipe selected for the odd-numbered heat exchange regions.

4. The heat exchange circulation system according to claim 1, wherein the second heat exchanger is a plate type heat exchanger for the heat exchange between the second flow path and a heat dissipating pipe.

5. The heat exchange circulation system according to claim 4, wherein the second heat exchanger is composed of multiple separated plates stacked together to provide a plurality of heat exchange regions among which those represented by odd-numbered heat exchange regions forms either the second flow path or the heat dissipating pipe, and those represented by even-numbered heat exchange regions forms the remainder of the second flow path or the heat dissipating pipe selected for the odd-numbered heat exchange regions.

6. The heat exchange circulation system according to claim 1, wherein the third heat exchanger is a plate type heat exchanger for the heat exchange between the third flow path and the fourth flow path.

7. The heat exchange circulation system according to claim 6, wherein the third heat exchanger comprises multiple separated plates stacked together to provide a plurality of heat exchange regions among which those represented by odd-numbered heat exchange regions forms either the third flow path or the fourth flow path, and those represented by even-numbered heat exchange regions forms the remainder of the third flow path or the fourth flow path selected for the odd-numbered heat exchange regions.

8. The heat exchange circulation system according to claim 1, wherein the liquid is a liquid water and the gas mixture is a mixture of a water vapor and air.

9. The heat exchange circulation system according to claim 1, further comprising a plurality of porous heat transfer medium that is installed the first flow path and the second flow path.

10. The heat exchange circulation system according to claim 9, wherein the porous heat transfer medium is a metal foam.

11. The heat exchange circulation system according to claim 1, further comprising a transmission device, the expansion device including a blade installed in the expansion pipe, the transmission device being connected to an axis of the blade and the compressor for transferring a work produced by the gas mixture upon turning the blade to the compressor.

12. A heat exchange circulation system, comprising:

a first heat exchanger which includes a first flow path that has a first gas inlet and a first gas outlet;

a second heat exchanger which includes a second flow path that has a second gas inlet and a second gas outlet;

a third heat exchanger which includes a third flow path, and a fourth flow path in thermal contact with the third flow path, the third flow path has a third gas inlet and a third gas outlet, the fourth flow path has a fourth gas inlet and a fourth gas outlet, the third gas inlet is connected to the first gas outlet, the fourth gas inlet is connected to the second gas outlet;

an expansion device which includes an expansion pipe that is connected to the fourth gas outlet and the first gas inlet;

a compressor which includes a compression pipe that is connected to the third gas outlet and the second gas inlet;

wherein the first flow path, the third flow path, the compression pipe, the second flow path, the fourth flow path and the expansion pipe together form a heat exchange circuit, the heat exchange circuit has a fluid medium flowing within it, the fluid medium includes a liquid and a gas mixture, the liquid exists in the first flow path, the second flow path, the third flow path and the fourth flow path, and the gas mixture circulates in the heat exchange circuit; and a non-volatile solute that is dissolved in the liquid of the fourth flow path.

13. The heat exchange circulation system according to claim 12, wherein the non-volatile solute is salt.

14. The heat exchange circulation system according to claim 13, wherein the non-volatile solute is common salt or bromide salt.

15. The heat exchange circulation system according to claim 12, wherein the second heat exchanger further includes a fifth flow path in thermal contact with the second flow path, and the heat exchanger circulation system further includes:

a dilute solution transmission line connected to the fourth flow path and the fifth flow path, the solution in the fourth flow path flowing to the fifth flow path through the dilute solution transmission line; and a concentrated solution return line connected to the fourth flow path and the fifth flow path, the solution in the fifth flow path flowing to the fourth flow path through the concentrated solution return line after giving out partial liquid during the distillation process in the fifth flow path; and a liquid return line connected to the first flow path, the second flow path, the third flow path and the fifth flow path, the liquid from the second flow path and the liquid condensed from the fifth flow path being directed to the first flow path and the third flow path.

16. The heat exchange circulation system according to claim 15, wherein the second heat exchanger is a plate type heat exchanger for the heat exchange among the second flow path, the fifth flow path and the heat dissipating pipe.

17. The heat exchange circulation system according to claim 16, wherein the second heat exchanger is composed of multiple separated plates stacked together to provide a plurality of heat exchange regions, one among every four heat exchange regions that is adjacent to the heat exchange regions where a condensed liquid from the solution locates, forms the heat dissipating pipe, two among every four heat exchange regions that are adjacent to each other with one of the heat exchange regions having the solution and the other heat exchange region receiving the condensed liquid from the solution, form the fifth flow path, and one of every four heat exchange regions that is adjacent to the heat exchange regions where the solution is, forms the second flow path.

* * * * *